US011485555B2

(12) United States Patent
Gonzalez Manzano et al.

(10) Patent No.: US 11,485,555 B2
(45) Date of Patent: Nov. 1, 2022

(54) CARRIER FOR CONTAINERS

(71) Applicant: Graphic Packaging International, LLC, Atlanta, GA (US)

(72) Inventors: Ana Maria Gonzalez Manzano, Igualada (ES); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/119,016

(22) Filed: Dec. 11, 2020

(65) Prior Publication Data

US 2021/0331848 A1 Oct. 28, 2021

Related U.S. Application Data

(63) Continuation of application No. 29/739,927, filed on Jun. 30, 2020, now Pat. No. Des. 946,417, and a continuation of application No. 29/739,929, filed on Jun. 30, 2020, now Pat. No. Des. 946,418.

(60) Provisional application No. 63/023,442, filed on May 12, 2020, provisional application No. 63/022,757, filed on May 11, 2020, provisional application No. 63/015,898, filed on Apr. 27, 2020.

(51) Int. Cl.
*B65D 71/42* (2006.01)

(52) U.S. Cl.
CPC ..... *B65D 71/42* (2013.01); *B65D 2571/0066* (2013.01); *B65D 2571/00253* (2013.01)

(58) Field of Classification Search
CPC ..... B65D 71/00; B65D 71/40; B65D 71/42; B65D 71/44; B65D 71/46; B65D 2571/00253; B65D 2571/00277; B65D 2571/0066
USPC ..... 206/149
See application file for complete search history.

(56) References Cited

U.S. PATENT DOCUMENTS

| | | | |
|---|---|---|---|
| 1,527,399 | A | 2/1925 | Davidson |
| 2,289,859 | A | 7/1942 | Arthur |
| 2,320,440 | A | 6/1943 | Kruea |

(Continued)

FOREIGN PATENT DOCUMENTS

| | | | |
|---|---|---|---|
| AT | 399701 | B | 7/1995 |
| CA | 2133827 | | 10/1993 |

(Continued)

OTHER PUBLICATIONS

U.S. Appl. No. 29/775,558, filed Mar. 24, 2021.

(Continued)

*Primary Examiner* — Bryon P Gehman
(74) *Attorney, Agent, or Firm* — Womble Bond Dickinson (US) LLP

(57) ABSTRACT

A carrier for holding a plurality of containers includes a plurality of panels having at least one central panel, at least one attachment panel foldably connected to the at least one central panel and configured to receive a portion of at least one container of the plurality of containers, and at least one side panel foldably connected to the at least one attachment panel. The at least one central panel includes a plurality of openings and is positioned between and attached to adjacent containers of the plurality of containers, and the at least one side panel is attached to at least one container of the plurality of containers.

64 Claims, 14 Drawing Sheets

(56) References Cited

U.S. PATENT DOCUMENTS

| | | | |
|---|---|---|---|
| 2,331,038 | A | 10/1943 | Meller |
| 2,397,376 | A | 3/1946 | Caldwell |
| 2,397,716 | A | 4/1946 | Wendler |
| 2,522,950 | A | 9/1950 | Keith |
| 2,594,376 | A | 4/1952 | Ameson |
| 2,594,377 | A | 4/1952 | Ameson |
| 2,737,326 | A | 3/1956 | Toensmeier |
| 2,798,603 | A | 7/1957 | Grinspoon |
| 2,950,041 | A | 8/1960 | Stone |
| 2,965,410 | A | 12/1960 | Hughes |
| 3,001,647 | A | 9/1961 | Liss |
| 3,046,711 | A | 7/1962 | Harrison |
| 3,061,141 | A | 10/1962 | Cote |
| 3,094,210 | A | 6/1963 | Van Der Berg |
| 3,099,475 | A | 7/1963 | Manizza |
| 3,118,537 | A | 1/1964 | Copping |
| 3,128,034 | A | 4/1964 | Weiss |
| 3,137,109 | A | 6/1964 | Rapata |
| 3,146,885 | A | 9/1964 | Grantham |
| 3,156,358 | A | 11/1964 | Randrup |
| 3,200,944 | A | 8/1965 | Rapata |
| 3,223,308 | A | 12/1965 | Weiss |
| 3,245,711 | A | 4/1966 | Dantoin |
| 3,257,066 | A | 6/1966 | Williams |
| 3,281,180 | A | 10/1966 | Spery |
| 3,302,784 | A | 2/1967 | Copping |
| 3,387,879 | A | 6/1968 | Wood |
| 3,410,596 | A | 11/1968 | Slevin, Jr. |
| 3,432,202 | A | 3/1969 | Ebelhardt |
| 3,463,535 | A | 8/1969 | Beart |
| 3,528,697 | A | 9/1970 | Wood |
| 3,587,847 | A | 6/1971 | Graser |
| 3,601,439 | A | 8/1971 | Pitch |
| 3,612,266 | A | 10/1971 | Graser |
| D222,579 | S | 11/1971 | Oglesbee |
| 3,627,121 | A | 12/1971 | Deasy |
| 3,653,503 | A | 4/1972 | Arneson |
| 3,693,787 | A | 9/1972 | Duerr |
| 3,698,550 | A | 10/1972 | Graser |
| 3,701,416 | A | 10/1972 | Lawrence |
| 3,722,945 | A | 3/1973 | Wood |
| 3,726,558 | A | 4/1973 | Klygis |
| 3,734,278 | A | 5/1973 | Kerrigan |
| 3,876,066 | A | 4/1975 | Klygis |
| 3,897,873 | A | 8/1975 | Graser |
| 3,924,739 | A | 12/1975 | Gravesteijn |
| 3,942,631 | A | 3/1976 | Sutherland et al. |
| 4,029,204 | A | 6/1977 | Manizza |
| 4,111,298 | A | 9/1978 | Mascia |
| 4,120,396 | A | 10/1978 | Mascia |
| 4,136,772 | A | 1/1979 | Mascia |
| 4,155,502 | A | 5/1979 | Forte |
| 4,190,149 | A | 2/1980 | Oliff et al. |
| D257,001 | S | 9/1980 | Oliff |
| 4,244,617 | A | 1/1981 | Manizza |
| 4,304,329 | A | 12/1981 | Graser |
| D265,292 | S | 7/1982 | Killy |
| 4,339,032 | A | 7/1982 | Wood |
| 4,372,599 | A | 2/1983 | Kiedaisch et al. |
| 4,378,879 | A | 4/1983 | Killy |
| 4,382,505 | A | 5/1983 | Sutherland et al. |
| 4,441,611 | A | 4/1984 | Sommariva |
| 4,471,870 | A | 9/1984 | Uhlig |
| 4,523,676 | A | 6/1985 | Barrash |
| 4,784,266 | A | 11/1988 | Chaussadas |
| D304,017 | S | 10/1989 | Oliff |
| 4,911,288 | A | 3/1990 | Dantoin, Jr. |
| 4,974,726 | A | 12/1990 | Klygis et al. |
| 5,002,225 | A | 3/1991 | Bienaime |
| 5,065,862 | A | 11/1991 | Mousseau |
| 5,103,971 | A | 4/1992 | Schuster |
| 5,125,506 | A | 6/1992 | Galbierz et al. |
| 5,135,104 | A | 8/1992 | Jorba |
| 5,139,147 | A | 8/1992 | Sutherland |
| 5,188,225 | A | 2/1993 | Jorba |
| 5,193,673 | A | 3/1993 | Rathbone et al. |
| 5,201,412 | A | 4/1993 | Schuster et al. |
| 5,230,425 | A | 7/1993 | Edqvist et al. |
| 5,246,113 | A | 9/1993 | Schuster |
| 5,263,299 | A | 11/1993 | Galbierz et al. |
| 5,267,644 | A | 12/1993 | Tsao |
| 5,282,348 | A | 2/1994 | Dampier et al. |
| 5,297,673 | A | 3/1994 | Sutherland |
| 5,310,050 | A | 5/1994 | Sutherland |
| 5,310,051 | A | 5/1994 | Sutherland |
| 5,314,224 | A | 5/1994 | Bates |
| 5,318,178 | A | 6/1994 | Davies et al. |
| 5,323,895 | A | 6/1994 | Sutherland et al. |
| 5,328,024 | A | 7/1994 | Sutherland |
| 5,335,774 | A | 8/1994 | Ganz |
| 5,351,815 | A | 10/1994 | Fogle et al. |
| 5,351,816 | A | 10/1994 | Sutherland et al. |
| 5,351,817 | A | 10/1994 | Sutherland |
| 5,355,999 | A | 10/1994 | Sutherland |
| 5,360,104 | A | 11/1994 | Sutherland |
| 5,390,784 | A | 2/1995 | Sutherland |
| 5,407,065 | A | 4/1995 | Sutherland |
| 5,415,278 | A | 5/1995 | Sutherland |
| 5,443,153 | A | 8/1995 | Sutherland |
| 5,445,262 | A | 8/1995 | Sutherland |
| 5,452,799 | A | 9/1995 | Sutherland |
| 5,484,053 | A | 1/1996 | Harris |
| 5,485,914 | A | 1/1996 | Martin |
| 5,487,464 | A | 1/1996 | Galbierz et al. |
| 5,490,593 | A | 2/1996 | Gordon et al. |
| 5,503,267 | A | 4/1996 | Sutherland |
| 5,520,283 | A | 5/1996 | Sutherland |
| 5,524,756 | A | 6/1996 | Sutherland |
| 5,551,566 | A | 9/1996 | Sutherland |
| 5,553,704 | A | 9/1996 | Gordon et al. |
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |
| 5,609,379 | A | 3/1997 | Harrelson |
| 5,682,982 | A | 11/1997 | Stonehouse |
| 5,706,936 | A | 1/1998 | Bernstein |
| 5,711,419 | A | 1/1998 | Beales et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,096,413 | B2 | 1/2012 | Coltri DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |

(56) References Cited

U.S. PATENT DOCUMENTS

| | | | | |
|---|---|---|---|---|
| 8,955,674 | B2 | 2/2015 | Spivey, Sr. et al. | |
| 9,079,699 | B2 | 7/2015 | Holley, Jr. | |
| 9,169,050 | B2 | 10/2015 | Spivey, Sr. | |
| 9,284,090 | B2 | 3/2016 | Lettre | |
| 9,359,093 | B2 | 6/2016 | DePaula et al. | |
| 9,376,250 | B2 | 6/2016 | Spivey, Sr. | |
| 9,446,891 | B2 | 9/2016 | Jones et al. | |
| 9,511,916 | B2 | 12/2016 | Holley, Jr. | |
| 9,669,976 | B2 | 6/2017 | Kastanek et al. | |
| 9,676,535 | B2 | 6/2017 | Spivey, Sr. | |
| 10,077,131 | B2 | 9/2018 | Lettre | |
| 10,836,550 | B2 | 11/2020 | Zacherle | |
| D920,809 | S | 6/2021 | Chesnet et al. | |
| 11,027,904 | B2 * | 6/2021 | McCree | B65D 71/42 |
| 11,027,905 | B2 | 6/2021 | Ford | |
| 11,180,301 | B2 | 11/2021 | Smalley | |
| 11,261,013 | B2 * | 3/2022 | Smalley | B65D 71/44 |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2004/0206639 | A1 | 10/2004 | Karlsson | |
| 2004/0211695 | A1 | 10/2004 | Karlsson | |
| 2004/0226833 | A1 | 11/2004 | Daniel | |
| 2005/0127151 | A1 | 6/2005 | Johnson | |
| 2005/0199513 | A1 | 9/2005 | Bakx et al. | |
| 2006/0255114 | A1 | 11/2006 | Hand et al. | |
| 2009/0101526 | A1 | 4/2009 | Sutherland et al. | |
| 2009/0127147 | A1 | 5/2009 | Sutherland | |
| 2010/0078337 | A1 | 4/2010 | Sutherland et al. | |
| 2010/0264043 | A1 | 10/2010 | DePaula | |
| 2012/0138489 | A1 | 6/2012 | Holley, Jr. | |
| 2015/0191287 | A1 | 7/2015 | L'Heureux et al. | |
| 2016/0325899 | A1 | 11/2016 | L'Heureux et al. | |
| 2018/0111734 | A1 | 4/2018 | Jego | |
| 2018/0222650 | A1 | 8/2018 | Zacherle | |
| 2018/0362234 | A1 | 12/2018 | L'Heureux et al. | |
| 2019/0119019 | A1 | 4/2019 | Patton | |
| 2020/0010255 | A1 | 1/2020 | Zacherle et al. | |
| 2020/0079564 | A1 | 3/2020 | Ford | |
| 2020/0189818 | A1 | 6/2020 | McCree | |
| 2020/0189819 | A1 | 6/2020 | McCree | |
| 2020/0189821 | A1 | 6/2020 | Smalley | |
| 2020/0189822 | A1 | 6/2020 | Smalley | |
| 2020/0223612 | A1 | 7/2020 | Swenson | |
| 2021/0061502 | A1 | 3/2021 | Johnston | |
| 2021/0094742 | A1 | 4/2021 | Gonzalez Manzano | |
| 2021/0276776 | A1 | 9/2021 | Zammit | |
| 2021/0316921 | A1 | 10/2021 | Holtz | |
| 2021/0331847 | A1 | 10/2021 | Gonzalez Manzano | |
| 2021/0331848 | A1 | 10/2021 | Gonzalez Manzano | |
| 2021/0339928 | A1 | 11/2021 | Blin | |
| 2022/0009685 | A1 | 1/2022 | Thompson | |

FOREIGN PATENT DOCUMENTS

| | | | | |
|---|---|---|---|---|
| DE | 298 13 672 | U1 | 11/1998 | |
| DE | 10 2009 059 047 | A1 | 6/2011 | |
| EP | 0 051 413 | A1 | 5/1982 | |
| EP | 0 060 504 | A2 | 9/1982 | |
| EP | 0 057 437 | B1 | 5/1985 | |
| EP | 0 496 807 | | 6/1993 | |
| EP | 0 636 096 | | 2/1995 | |
| EP | 0 715 593 | A1 | 6/1996 | |
| EP | 0 398 835 | B1 | 10/1996 | |
| EP | 2 067 713 | A1 | 6/2009 | |
| EP | 1 528 007 | B1 | 10/2010 | |
| EP | 2739547 | B1 | 7/2017 | |
| EP | 3 666 684 | A1 | 6/2020 | |
| FR | 2 737 196 | A1 | 1/1997 | |
| GB | 1 256 684 | | 12/1971 | |
| GB | 2 321 229 | A | 7/1998 | |
| JP | 10-297668 | A | 11/1998 | |
| JP | 2001-519300 | A | 10/2001 | |
| JP | 2003-146359 | | 5/2003 | |
| JP | 2004-189243 | A | 7/2004 | |
| JP | 2015-048088 | A | 3/2015 | |
| KR | 10-2005-0051616 | A | 6/2005 | |
| KR | 10-2020-0106806 | A | 9/2020 | |
| WO | WO 93/02941 | | 2/1993 | |
| WO | WO 93/21083 | | 10/1993 | |
| WO | WO 93/25439 | A1 | 12/1993 | |
| WO | WO 94/22738 | A1 | 10/1994 | |
| WO | WO 95/01289 | A1 | 1/1995 | |
| WO | WO 95/06604 | | 3/1995 | |
| WO | WO 96/26128 | A1 | 8/1996 | |
| WO | WO 96/32340 | A1 | 10/1996 | |
| WO | WO 2008/058294 | A1 | 5/2008 | |
| WO | WO 2010/006629 | A1 | 1/2010 | |
| WO | WO-2010101852 | A1 * | 9/2010 | B65D 71/42 |

OTHER PUBLICATIONS

U.S. Appl. No. 29/775,559, filed Mar. 24, 2021.
U.S. Appl. No. 29/775,560, filed Mar. 24, 2021.
U.S. Appl. No. 29/818,355, filed Dec. 8, 2021.
U.S. Appl. No. 29/819,435, filed Dec. 15, 2021.
U.S. Appl. No. 29/819,437, filed Dec. 15, 2021.
U.S. Appl. No. 29/819,438, filed Dec. 15, 2021.
U.S. Appl. No. 29/819,440, filed Dec. 15, 2021.
U.S. Appl. No. 17/573,911, filed Jan. 12, 2022.
International Search Report and Written Opinion for PCT/US2020/054205 dated Jan. 20, 2021.
U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 17/118,999, filed Dec. 11, 2020.
U.S. Appl. No. 17/119,040, filed Dec. 11, 2020.
International Search Report and Written Opinion for PCT/US2019/034491 dated Sep. 19, 2019.
International Search Report and Written Opinion for PCT/US2019/034490 dated Sep. 19, 2019.
International Search Report and Written Opinion for PCT/US2019/034494 dated Sep. 19, 2019.
International Search Report and Written Opinion for PCT/US2019/034489 dated Sep. 19, 2019.
International Search Report and Written Opinion for PCT/US2019/034493 dated Sep. 20, 2019.
International Search Report and Written Opinion for PCT/US2020/024614 dated Sep. 15, 2020.
European Search Report for EP 19 18 0439 dated Jan. 10, 2020.
European Search Report for EP 19 18 0460 dated Jan. 13, 2020.
European Search Report for EP 19 18 0436 dated Jan. 22, 2020.
European Search Report for EP 19 18 0446 dated Feb. 3, 2020.
European Search Report for EP 19 18 0453 dated Feb. 10, 2020.
European Search Report for EP 20 16 8268 dated Oct. 2, 2020.
International Search Report and Written Opinion for PCT/US2020/064472 dated Mar. 15, 2021.
International Search Report and Written Opinion for PCT/US2020/064471 dated Mar. 29, 2021.
International Search Report and Written Opinion for PCT/US2020/064473 dated Apr. 1, 2021.
European Search Report for EP 20 20 533 dated Mar. 23, 2021.

(56) References Cited

OTHER PUBLICATIONS

European Search Report for EP 20 21 5364 dated Jul. 1, 2021.
European Search Report for EP 20 21 5371 dated Jul. 1, 2021.
European Search Report for EP 20 21 5399 dated Jul. 1, 2021.
International Search Report and Written Opinion for PCT/US2021/052279 dated Jan. 5, 2022.
International Search Report and Written Opinion for PCT/US2021/052278 dated Jan. 5, 2022.
International Search Report and Written Opinion for PCT/US2021/052272 dated Jan. 7, 2022.
International Search Report and Written Opinion for PCT/US2021/052290 dated Jan. 21, 2022.

* cited by examiner

CARRIER FOR CONTAINERS

CROSS-REFERENCE TO RELATED APPLICATIONS

This application claims the benefit of U.S. Provisional Patent Application No. 63/022,757, filed on May 11, 2020, U.S. Provisional Patent Application No. 63/015,898, filed on Apr. 27, 2020, and U.S. Provisional Patent Application No. 63/023,442, filed on May 12, 2020, and is a continuation of U.S. Design patent application No. 29/739,927, filed on Jun. 30, 2020, and U.S. Design patent application No. 29/739,929, filed on Jun. 30, 2020.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application No. 29/692,992, filed on May 30, 2019, U.S. Design patent application No. 29/692,993, filed on May 30, 2019, U.S. Design patent application No. 29/692,994, filed on May 30, 2019, U.S. Design patent application No. 29/692,996, filed on May 30, 2019, U.S. Design patent application No. 29/692,997, filed on May 30, 2019, U.S. patent application Ser. No. 16/598,282, filed on Oct. 10, 2019, U.S. Design patent application No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design patent application No. 29/735,178, filed on May 19, 2020, U.S. Provisional Patent Application No. 63/031,615, filed on May 29, 2020, U.S. Design patent application No. 29/739,927, filed on Jun. 30, 2020, U.S. Design patent application No. 29/739,929, filed on Jun. 30, 2020, U.S. Design patent application No. 29/739,931, filed on Jun. 30, 2020, U.S. Design patent application No. 29/739,933, filed on Jun. 30, 2020, U.S. Design patent application No. 29/739,934, filed on Jun. 30, 2020, U.S. Provisional Patent Application No. 63/085,365, filed on Sep. 30, 2020, and U.S. Provisional Patent Application No. 63/086,681, filed on Oct. 2, 2020, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising at least one central panel, at least one attachment panel foldably connected to the at least one central panel and configured to receive a portion of at least one container of the plurality of containers, and at least one side panel foldably connected to the at least one attachment panel. The at least one central panel comprises a plurality of openings and is positioned between and attached to adjacent containers of the plurality of containers, and the at least one side panel is attached to at least one container of the plurality of containers.

According to another aspect, the disclosure is generally directed to a blank for forming a carrier for holding a plurality of containers, the blank comprising a plurality of panels comprising at least one central panel, at least one attachment panel foldably connected to the at least one central panel and configured to receive a portion of at least one container of the plurality of containers, and at least one side panel foldably connected to the at least one attachment panel. The at least one central panel comprises a plurality of openings and is for being positioned between and attached to adjacent containers of the plurality of containers when the container is formed from the blank, and the at least one side panel is for being attached to at least one container of the plurality of containers when the container is formed from the blank.

According to another aspect, the disclosure is generally directed to a method of forming a carrier for holding a plurality of containers, the method comprising obtaining a blank comprising a plurality of panels comprising at least one central panel comprising a plurality of openings, at least one attachment panel foldably connected to the at least one central panel and configured to receive a portion of at least one container of the plurality of containers, and at least one side panel foldably connected to the at least one attachment panel. The method further comprises folding the plurality of panels such that the at least one central panel is positioned between adjacent containers of the plurality of containers, attaching the at least one central panel to the adjacent containers of the plurality of containers, attaching the at least one attachment panel to at least one container of the plurality of containers, and attaching the at least one side panel to at least one container of the plurality of containers.

According to another aspect, the disclosure is generally directed to a package comprising a plurality of containers and a carrier holding the plurality of containers. The carrier comprises a plurality of panels comprising at least one central panel, at least one attachment panel foldably connected to the at least one central panel and receiving a portion of at least one container of the plurality of containers, and at least one side panel foldably connected to the at least one attachment panel. The at least one central panel comprises a plurality of openings and is positioned between and attached to adjacent containers of the plurality of containers, and the at least one side panel is attached to at least one container of the plurality of containers.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
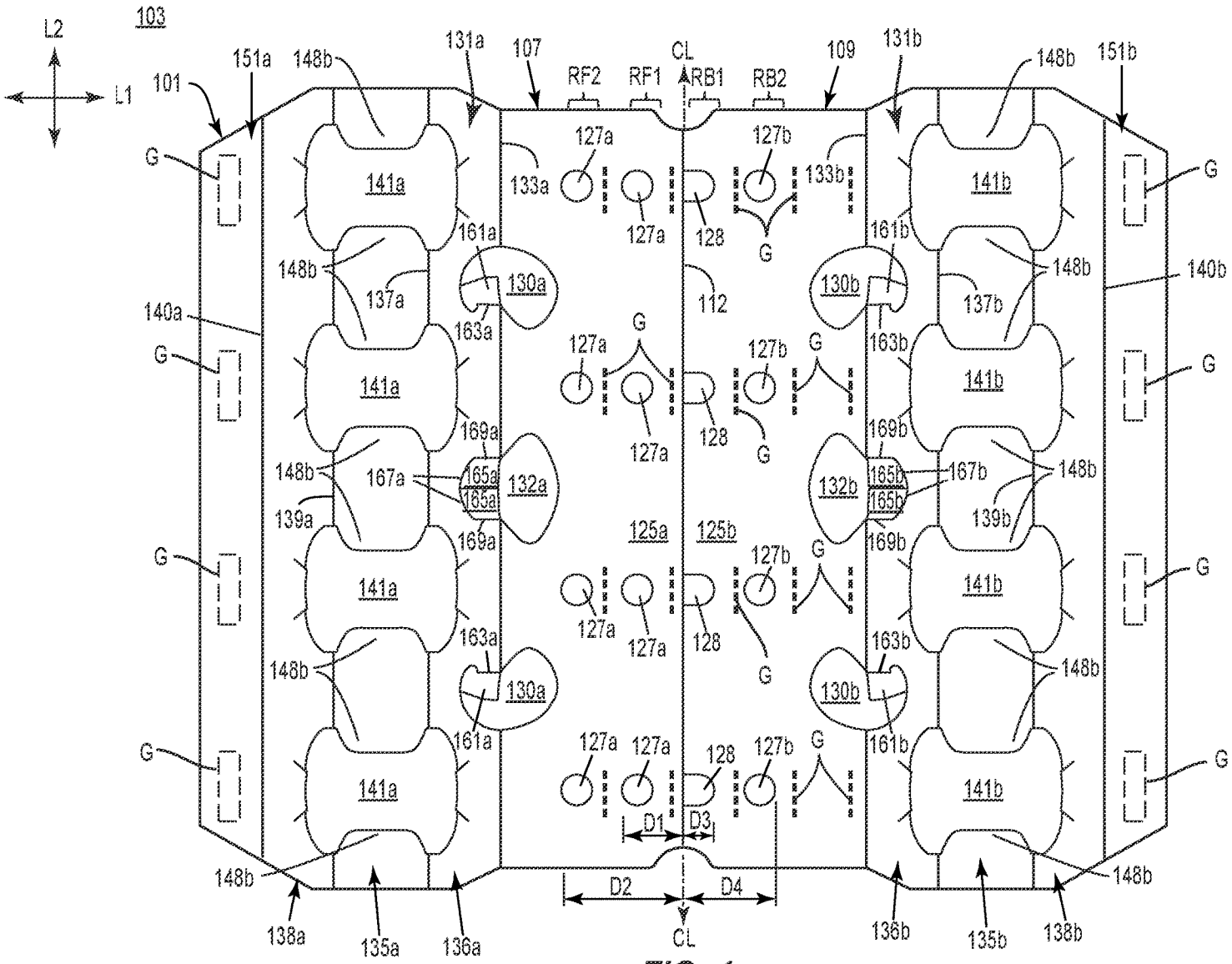
FIG. 1 is a schematic plan view of an outer surface of a blank for forming a carrier according to a first exemplary embodiment of the disclosure.
Figure 6:
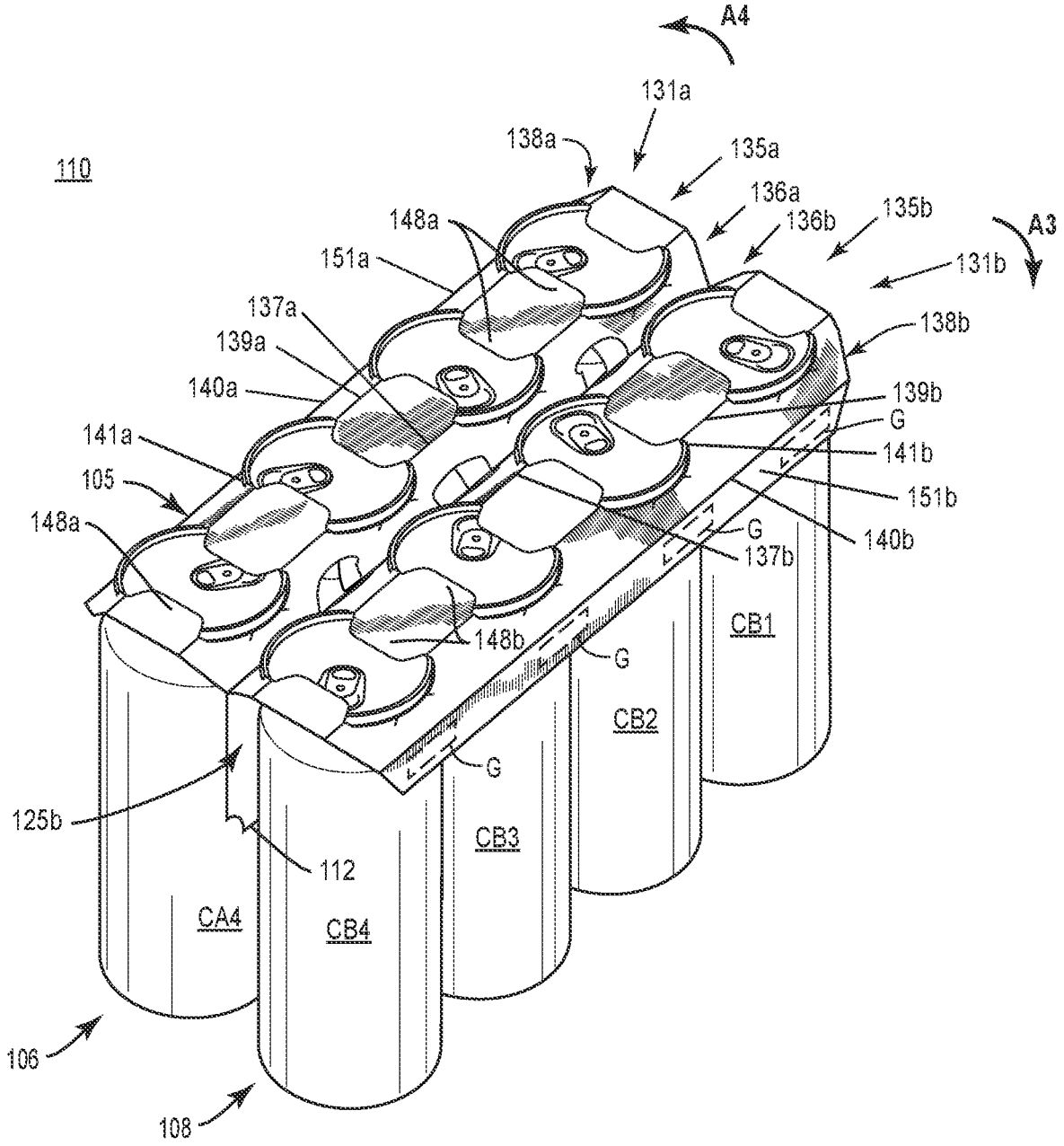
FIG. 6 is a perspective view of a package and carrier formed from the blank of FIG. 1 according to the first exemplary embodiment.

FIG. 1 shows a schematic plan view of an exterior side 101 of a blank 103 used to form a carrier 105 (FIG. 6) in accordance with a first exemplary embodiment of the disclosure. As shown in FIG. 6, the carrier 105 is sized to contain or support eight containers, with four containers CA1, CA2, CA3, CA4 being attached to a front portion 106 of the carrier 105 and four containers CB1, CB2, CB3, CB4 being attached to a back portion 108 of the carrier 105. In the illustrated embodiment, the containers CA1, CA2, CA3, CA4, CB1, CB2, CB3, CB4 can be beverage cans, or could be any other suitable type and size of container without departing from the disclosure. The carrier 105 can be sized and shaped to hold more or less than eight containers.

In one embodiment, the front portion 106 and the back portion 108 of the carrier 105 each have four containers, and in other embodiments, the front portion 106 and the back portion 108 of the carrier 105 can carry more or less than four containers without departing from the disclosure. The carrier 105 can be provided together with one or more containers as a package 110 (FIG. 6).

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that the front portion 107 and the back portion 109 of the blank 103 are overlapped in at least partial face-to-face contact.

In the illustrated embodiment, the front portion 107 of the blank 103 comprises a front central panel 125*a* having a first front row RF1 of laterally spaced adhesive or glue openings 127*a*, and a second front row RF2 of the laterally spaced adhesive or glue openings 127*a*. The top edges of the respective glue openings 127*a* of the first row RF1 are spaced a longitudinal distance D1 apart from the fold line 112 that is less than a longitudinal distance D2 that the top edges of the respective glue openings 127*a* of the second row RF2 are spaced apart from the fold line 112.

A front container retention panel or front attachment panel 131*a* is foldably connected to the front central panel 125*a* at a lateral fold line 133*a*, and includes a container retention portion 135*a* that is at least partially defined between a pair of longitudinally-spaced lateral fold lines 137*a*, 139*a* that are each interrupted by respective laterally-spaced cuts container openings 141*a*.

Figure 1B:
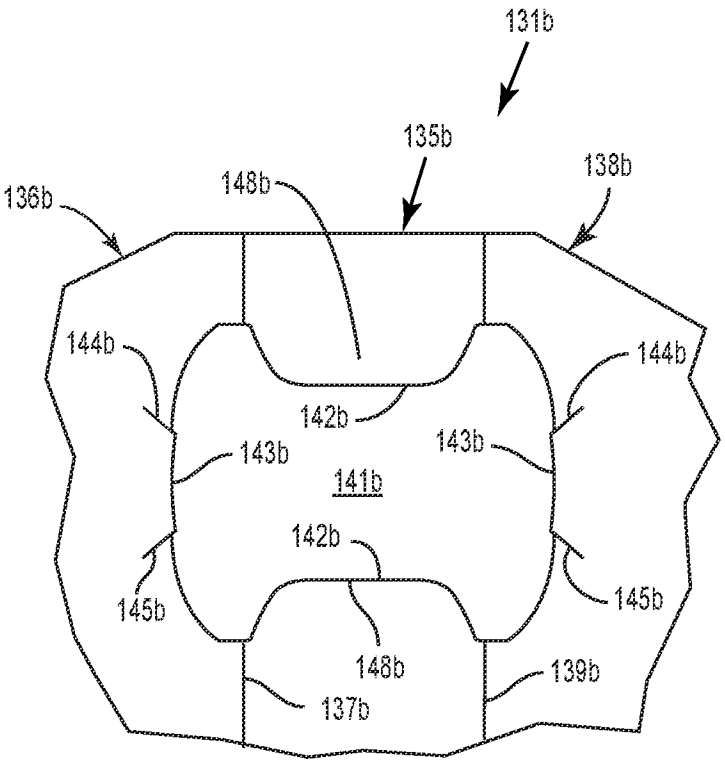
FIG. 1B is an enlarged view of another portion of the blank of FIG. 1.
Figure 1A:
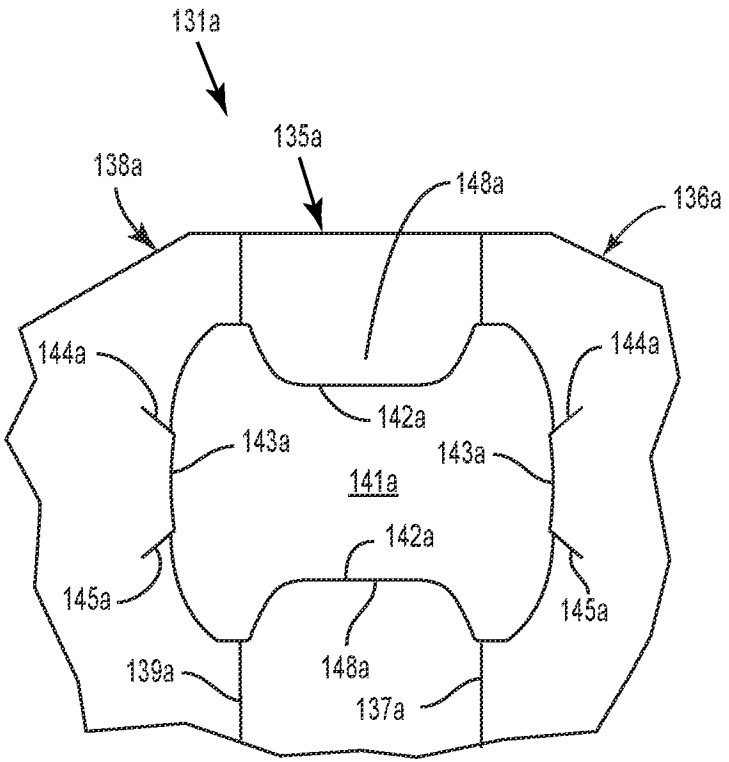
FIG. 1A is an enlarged view of a portion of the blank of FIG. 1.

As best shown in FIG. 1A, the attachment panel 131*a* can include container retention features that include at least laterally-spaced container openings 141*a* are defined in respective cuts in the blank 103 that define a pair of laterally spaced curved edge portions 142*a* that intersect respective longitudinally spaced curved edge portions 143*a* to form the respective container openings 141*a*.

The edge portions 142*a* of the blank 103 around the container openings 141*a*, as shown, can have a generally U-shaped or generally V-shaped configuration so as to define a pair of lateral container retention tabs 148*a* that protrude/extend into the respective laterally-spaced container openings 141*a*.

As also shown, respective oblique cuts 144*a*, 145*a* extend outwardly from each respective curved edge portion 143*a* to define a plurality of reconfigurable edges of the front attachment panel 131*a* adjacent the respective container openings 141*a*.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral fold line 140*a*.

A bevel or front side panel 151*a*, as shown, is foldably connected to the front attachment panel 131*a* at the lateral fold line 140*a*, and defines a lateral free edge of the blank 103.

The blank 103 can include handle features that include at least a pair of handle openings 130*a* that interrupts the fold line 133*a* and that extends from a portion of the front central panel 125*a* into a portion of the front attachment panel 131*a*. The handle openings 130*a* can be formed by one or more cuts that include one or more curved and/or angled portions. A handle reinforcement tab 161*a*, as shown, can be foldably connected to the front attachment panel 131*a* at respective longitudinal fold lines 163*a* and can be positioned to extend into the respective handle openings 130*a*.

As also shown, the handle features can include a handle opening 132*a* that can be positioned between the handle openings 130*a*, and that is formed in the front central panel 125*a* by one or more cuts that include one or more curved and/or angled portions. A pair of handle reinforcement tabs 165*a* can also be at least partially formed by respective curved cuts 167*a* and separated from one another at a longitudinal cut. The handle reinforcement tabs 165*a*, as shown, can be foldably connected to the front attachment panel 131*a* at respective longitudinal fold lines 169*a* and can be positioned abutting the handle opening 132*a*.

The carrier 105 can have a different arrangement of handle features, or can be devoid of handle features, without departing from the disclosure.

In the illustrated embodiment, the back portion 109 of the blank 103 includes a back central panel 125*b*, a back container retention panel or back attachment panel 131*b*, and a back bevel panel or back side panel 151*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103. The features of the back attachment panel 131*a* are best shown in FIG. 1B.

As shown, the back central panel 125*a* includes a first back lateral row of glue openings 128 that at least partially interrupt the fold line 112 and have an upper edge spaced a longitudinal distance D3 from the fold line 112. The back central panel 125*b* also includes a second back lateral row RB2 of glue openings 127*b* with an upper edge spaced apart a longitudinal distance D4 from the fold line 112, the longitudinal distance D4 being greater than the longitudinal distance D3.

In the illustrated embodiment, the glue openings 127*a*, 127*b* can have a generally circular profile and the glue openings 128 can have a generally semicircular/semi-ovoid configuration. It will be understood that one or more of the glue openings 127*a*, 127*b*, 128 can have a different configuration than provided in FIG. 1, e.g., generally circular, generally oblong, generally semicircular/semi-ovoid, generally rectangular, etc., without departing from the disclosure.

In this regard, the blank 103 is provided with front rows RF1 and RF2 of respective laterally-spaced front glue openings 127*a* that are spaced respective longitudinal distances D1, D2 from the centerline CL, and back rows RB1 and RB2 of respective laterally-spaced back glue openings 128, 127*b* that are spaced respective longitudinal distances D3, D4 from the centerline CL. The glue openings 127*a*, 127*b*, 128 have a longitudinally staggered arrangement such that D2>D4>D1>D3. Upon formation of the carrier 105 from the blank 103, the longitudinal centerline CL/fold line 112 can form a bottom edge of the central panels 125*a*, 125*b*.

As described herein, the arrangement of the glue openings 127*a*, 127*b*, 128 is such that, upon erection of the carrier 105, the glue openings 127*a*, 127*b*, 128 provide access to respective surfaces of the central panel 125*b* upon which the respective containers CA1, CA2, CA3, CA4 can be attached and the glue openings 128, 127*b* provide access to respective surfaces of the central panel 125*a* upon which the respective containers CB1, CB2, CB3, CB4 can be attached. Such an arrangement of the glue openings 127*a*, 127*b*, 128 can be provided to enhance retention and support of the containers CA1, CA2, CA3, CA4, CB1, CB2, CB3, CB4 by the carrier 105. It will be understood that the glue openings 127*a*, 127*b*, 128 can be provided in a different number or arrangement without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than eight containers without departing from this disclosure.

Figure 2:
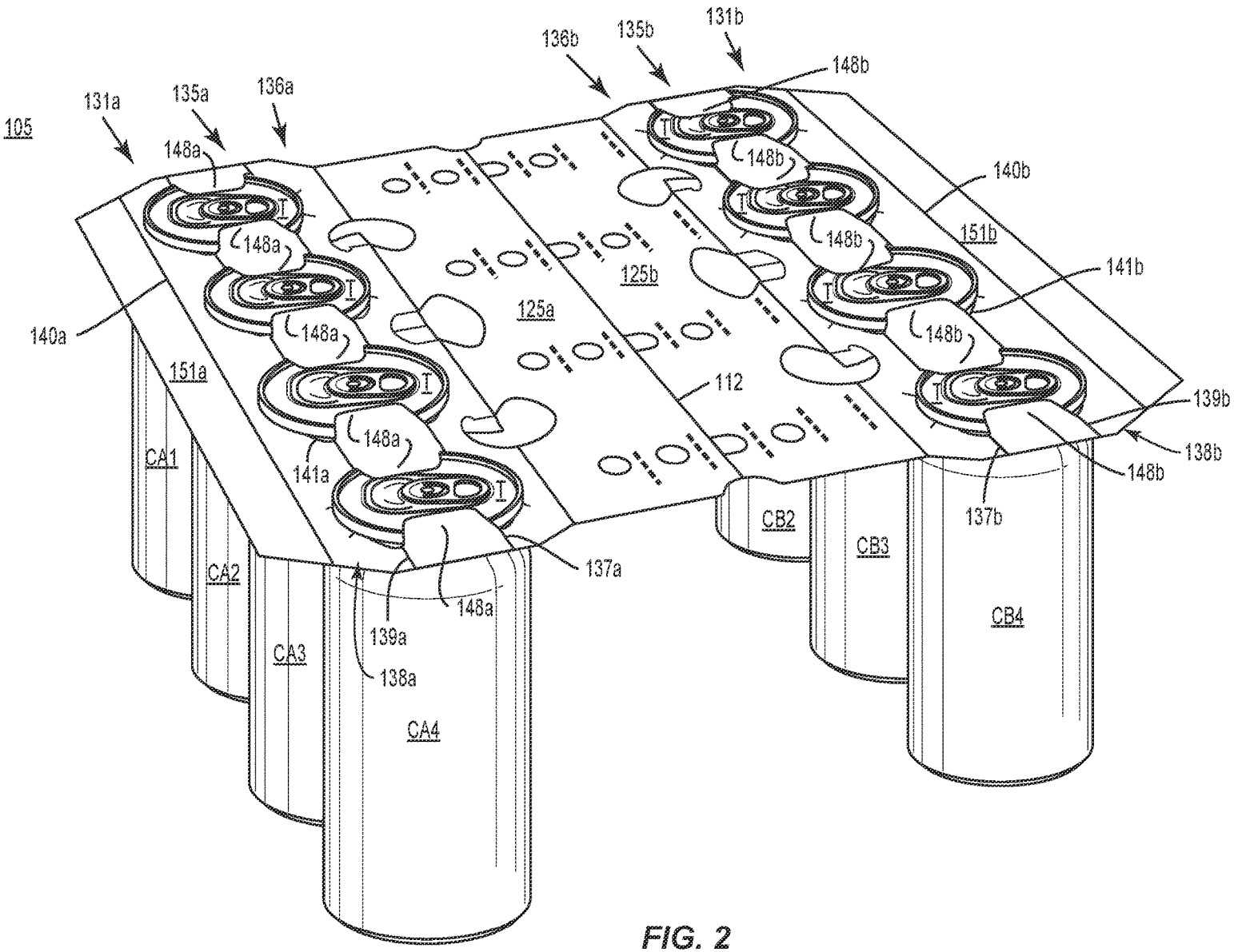
FIG. 2 is perspective view of a partially folded configuration of a carrier formed from the blank of FIG. 1 according to the first exemplary embodiment.
Figure 3:
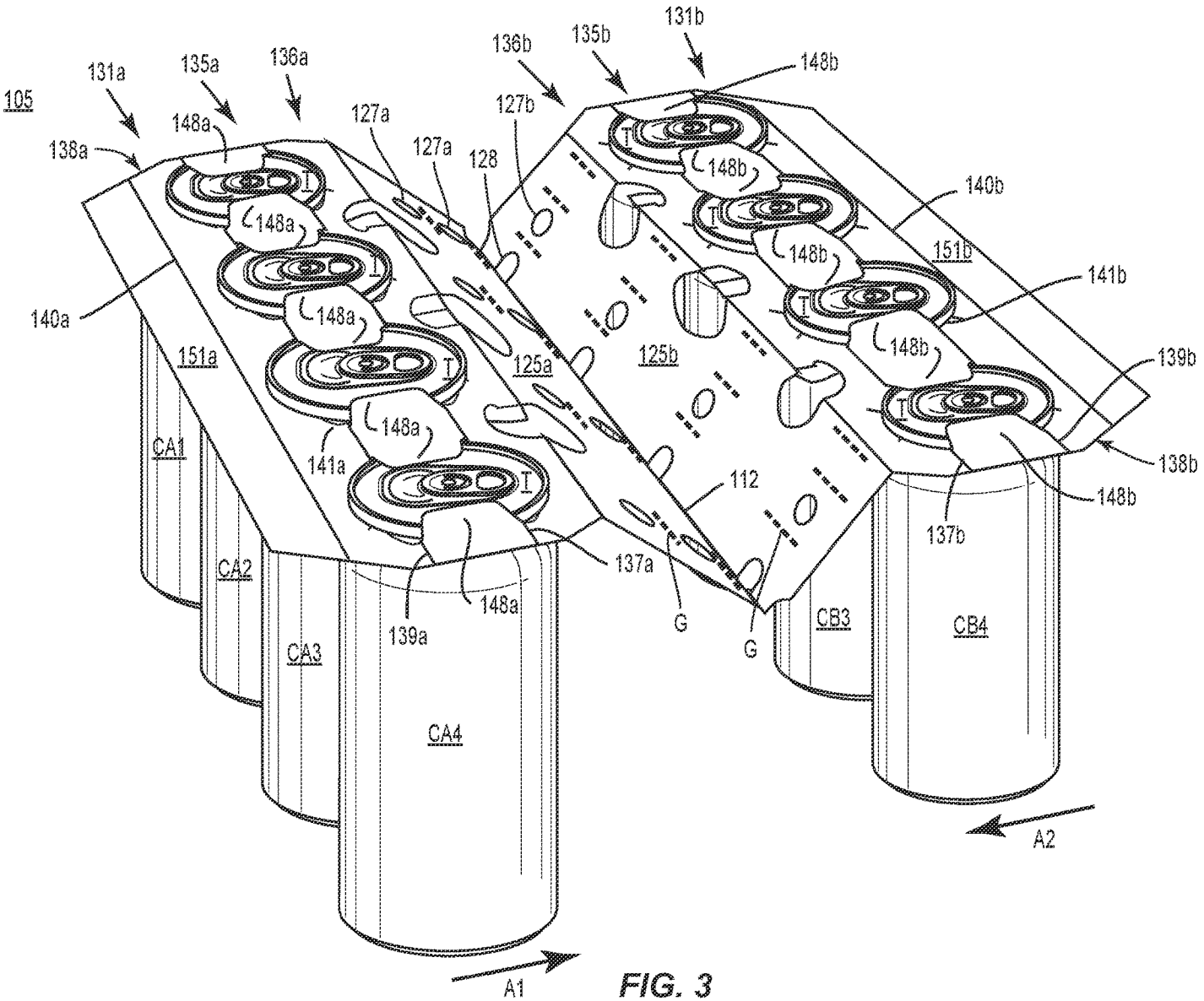
FIG. 3 is a perspective view of another partially folded configuration of a carrier formed from the blank of FIG. 1 according to the first exemplary embodiment.

As shown in FIGS. 2 and 3, the blank 103 can be positioned with the exterior surface 101 facing upwardly and such that an underside or interior surface of the blank 103 is positioned facing the containers CA1, CA2, CA3, CA4, CB1, CB2, CB3, CB4. The blank 103 can be placed atop the containers CA1, CA2, CA3, CA4, CB1, CB2, CB3, CB4 such that the container retention portion 135*a* of the front attachment panel 131*a* overlies the containers CA1, CA2, CA3, CA4 and such that the container retention portion 135*b* of the back attachment panel 131*b* overlies the containers CB1, CB2, CB3, CB4. Further downward positioning of the attachment panels 131*a*, 131*b* over the plurality of containers CA1, CA2, CA3, CA4, CB1, CB2, CB3, CB4 can activate the respective container retention portions 135*a*, 135*b* to engage respective containers.

For example, as the front attachment panel 131*a* is lowered or urged downwardly onto the containers CA1, CA2, CA3, CA4, upper or top portions T of the respective containers CA1, CA2, CA3, CA4 can be at least partially received through the container openings 141*a* in the front attachment panel 131*a*. In such an arrangement, the container retention tabs 148*a* can engage, for example, a recessed portion of a rim or other top structure of the respective container CA1, CA2, CA3, CA4 and such that a plurality of reconfigurable edges of the marginal portions 136*a*, 138*a* defined by the curved edge portions 143*a* and oblique cuts 144*a*, 145*a* can engage, for example, a rolled rim edge or other top structure of the respective container CA1, CA2, CA3, CA4.

It will be understood that portions of the container retention portion 135*a* of the front attachment panel 131*a*, e.g., portions of the container retention portion 135*a* between adjacent container openings 141*a*, can flexibly reconfigure in the course of engaging respective containers.

In this regard, the top portions T of the respective containers CA1, CA2, CA3, CA4 can protrude through/be partially exposed through the respective container openings 141*a* so as to be visible by a customer or operator.

Such reconfiguration of the corresponding portions of the back attachment panel 131*b* can occur as the back attachment panel 131*b* is lowed or urged downwardly onto the containers CB1, CB2, CB3, CB4. During the above-described engagement of the respective container retention portions 135*a*, 135*b* with the respective containers, the marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*.

Still referring to FIGS. 2 and 3, the front central panel 125*a* and the back central panel 125*b* can be folded at the fold line 112 such that the front central panel 125*a* and the back central panel 125*b* are brought into at least partial face-to-face contact in the direction of the respective arrows A1, A2 to be positioned between respective adjacent containers and such that the respective glue openings 127*a* and glue openings 128, 127*b* are positioned so as to be laterally aligned but longitudinally offset due to the different relative spacing of the respective rows RF1, RF2 of respective front glue openings 127*a* and the respective rows RB1, RB2 of respective back glue openings 128, 127*b* away from the fold line 112/lateral centerline CL as described above.

Figure 4:
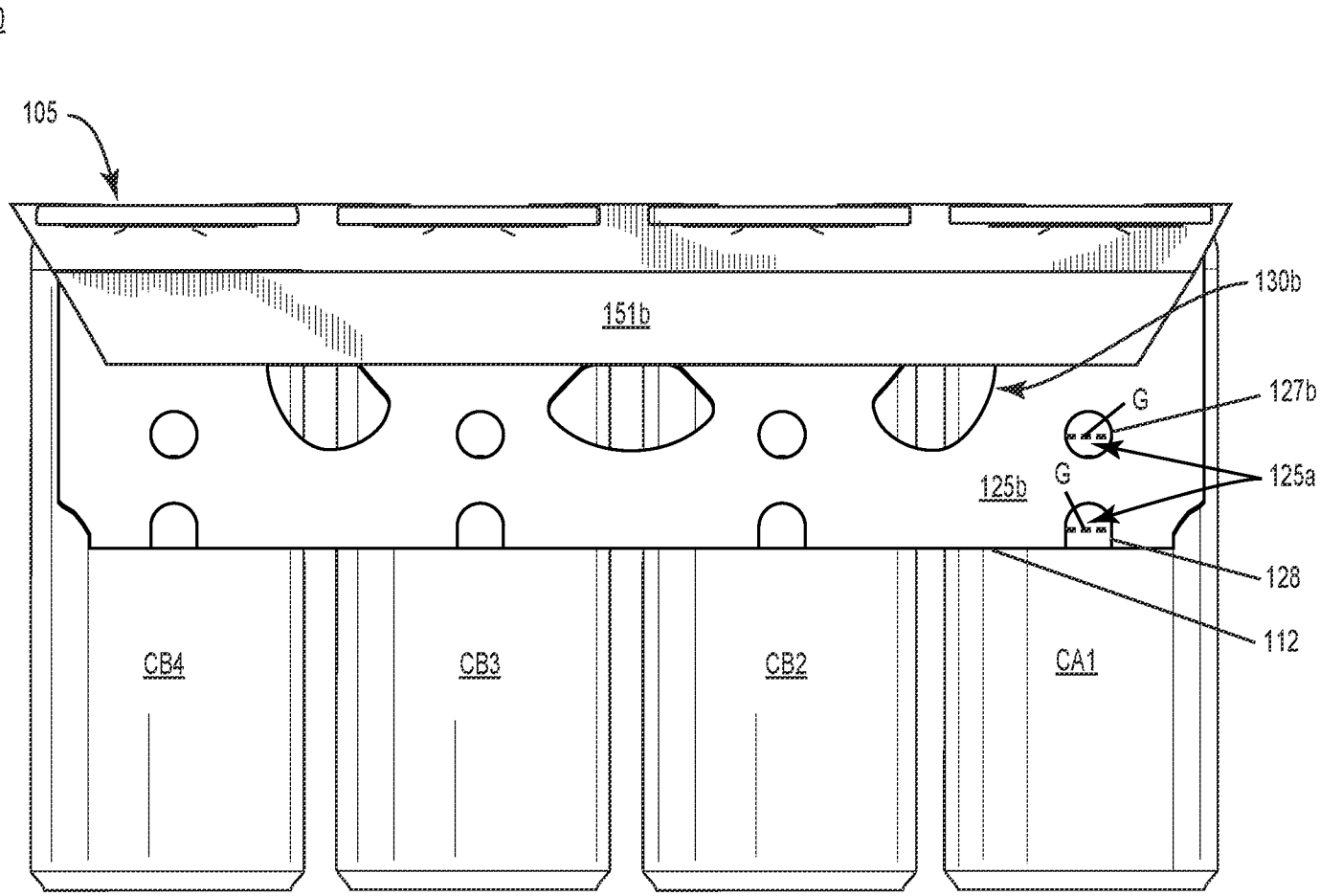
FIG. 4 is a front view of a carrier formed from the blank of FIG. 1 according to the first exemplary embodiment and having a container removed therefrom.
Figure 5:
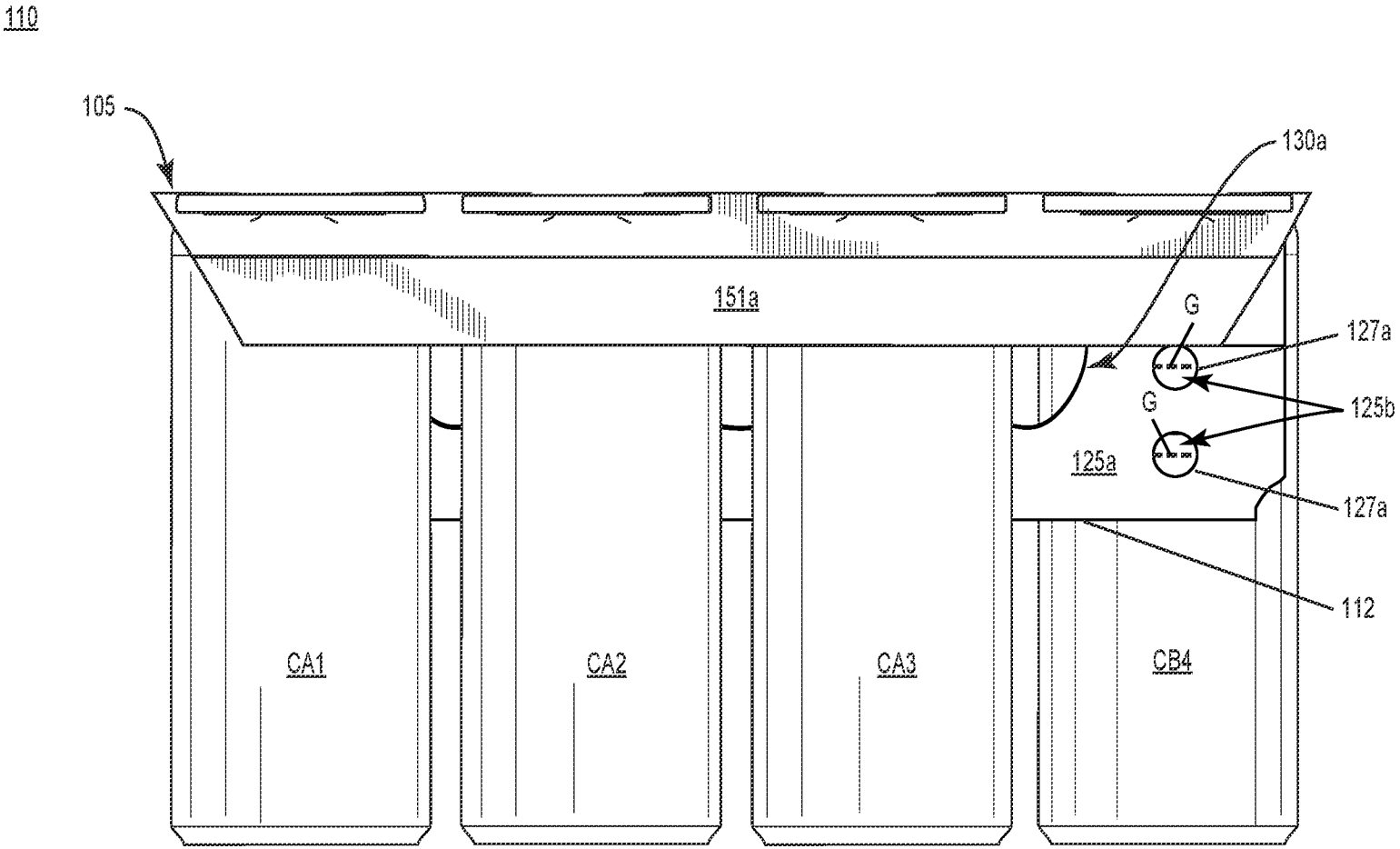
FIG. 5 is a rear view of the carrier of FIG. 4 and having a container removed therefrom.

In this regard, and with additional reference to FIGS. 4 and 5, the central panels 125*a*, 125*b* are arranged such that a portion of the front central panel 125*a* overlaps each of the glue openings 128, 127*b* and a portion of the back central panel 125*b* overlaps each of the glue openings 127*a* to provide communication between the central panels 125*a*, 125*b* and respective surfaces upon which the respective containers CAL CA2, CA3, CA4, CB1, CB2, CB3, CB4 can be adhered or otherwise attached, as described further herein. Such rearrangement of the central panels 125*a*, 125*b* can also cause the respective central panels 125*a*, 125*b* to be folded downwardly relative to the respective attachment panels 131*a*, 131*b* at the respective fold lines 133*a*, 133*b*.

An adhesive glue G (FIG. 1) can be provided to adhere the containers CAL CA2, CA3, CA4 to respective portions of the central panel 125*b* exposed through the respective glue openings 127*a* and the glue G can be provided to adhere the containers CB1, CB2, CB3, CB4 to respective portions of the central panel 125*a* exposed through the respective glue openings 128, 127*b*. The arrangement of multiple rows of respective glue openings 127*a*, 127*b*, 128 provides multiple points of attachment of each respective container to the respective opposite central panel 125*a*, 125*b* such that each container is provided with a robust attachment to a respective central panel 125*a*, 125*b*.

The attachment of the containers CA1, CA2, CA3, CA4, CB1, CB2, CB3, CB4 to the respective central panel 125*a*, 125*b* can provide retention and support of the respective containers, e.g., such that the containers do not detach from the carrier 105 under their own weight, in addition to or alternative to the container retention and support provided by the respective container retention portions 135*a*, 135*b*. For example, in one embodiment, one or more of the containers CA1, CA2, CA3, CA4, CB1, CB2, CB3, CB4 can be attached to a respective central panel 125*a*, 125*b* with glue G, without additional retention and support provided by a container retention portion as described above.

Such enhanced attachment of the respective containers to the respective central panels 125*a*, 125*b* with the glue G can also provide enhanced integrity to the carrier 105, e.g., by providing opposing adhesive forces on the respective central panels 125*a*, 125*b* such that the central panels 125*a*, 125*b* are compressed therebetween. For example, in one embodiment, as the carrier 105 is lifted, the containers CA1, CA2, CA3, CA4 can at least partially pull the portions of the back central panel 125*b* to which they are attached through the respective glue openings 127*a* toward the front central panel 125*a* under the at least partial weight of the containers CA1, CA2, CA3, CA4. Respective portions of the front central panel 125*a* can be pulled toward the back central panel 125*b* through the respective glue openings 128, 127*b* by the containers CB1, CB2, CB3, CB4 in a similar manner.

With additional reference to FIG. 6, the front side panel 151*a* can be folded/urged downwardly at the fold line 140*a* in the direction of the arrow A3, for example, to be at an oblique arrangement relative to the containers CA1, CA2, CA3, CA4, CB1, CB2, CB3, CB4. Similarly, the back side panel 151*b* can be folded/urged downwardly at the fold line 140*b* in the direction of the arrow A4 into an oblique arrangement with the containers CA1, CA2, CA3, CA4, CB1, CB2, CB3, CB4.

Such downward movement of the side panels 151*a*, 151*b* can be such that at least a portion of the interior surface of the side panels 151*a*, 151*b* is positioned in at least partial face-to-face contact with one or more respective containers. As shown, the interior surface of the side panels 151*a*, 151*b* can be provided with glue G (illustrated in broken lines) so as to adhere the side panels 151*a*, 151*b* to one or more respective container CA1, CA2, CA3, CA4, CB1, CB2, CB3, CB4.

Accordingly, the attachment of the side panels 151*a*, 151*b* to one or more of the respective containers CA1, CA2, CA3, CB1, CB2, CB3, CB4 with glue G provides additional support to the containers by the package 110/carrier 105, and can provide enhanced integrity to the package 110/carrier 105. In one embodiment, one or more of the containers CA1, CA2, CA3, CA4, CB1, CB2, CB3, CB4 can be attached to a respective side panel 151*a*, 151*b* with glue G, as described above, with a corresponding lessened amount of retention/support provided by the central panels 125*a*, 125*b* and/or the attachment panels 131*a*, 131*b*.

The glue G described herein can be, for example, a hot melt adhesive, a high tack glue, an epoxy, a polymeric cement, etc., or combinations thereof. The glue G can have a different arrangement without departing from the disclosure. For example, in one embodiment, the glue G can be applied to one or more portions of the interior surface of the blank 103/carrier 105.

In another embodiment, the glue G can have a foam or foamed configuration, e.g., such that pockets of fluids such as gas are interspersed with solid, semi-solid, and/or liquid components of adhesive. In this regard, the glue G can be injected/infused with a fluid, e.g., gaseous, component that influences the glue G to expand from an originally-defined volume, over a change in time, to occupy a larger volume. In one embodiment, the glue G can comprise about 50% solid/semi-solid/liquid adhesive and about 50% gaseous components.

In other embodiments, the glue G can comprise a different ratio of adhesive to gaseous components, for example, about 10% adhesive/about 90% gaseous components, about 20% adhesive/about 80% gaseous components, about 30% adhesive/about 70% gaseous components, about 40% adhesive/about 60% gaseous components, about 60% adhesive/about 40% gaseous components, about 70% adhesive/about 30% gaseous components, about 80% adhesive/about 20% gaseous components, about 90% adhesive/about 10% gaseous components, or other integer or non-integer percentage ratios therebetween. The glue G can be any suitable adhesive without departing from the disclosure.

Figure 7:
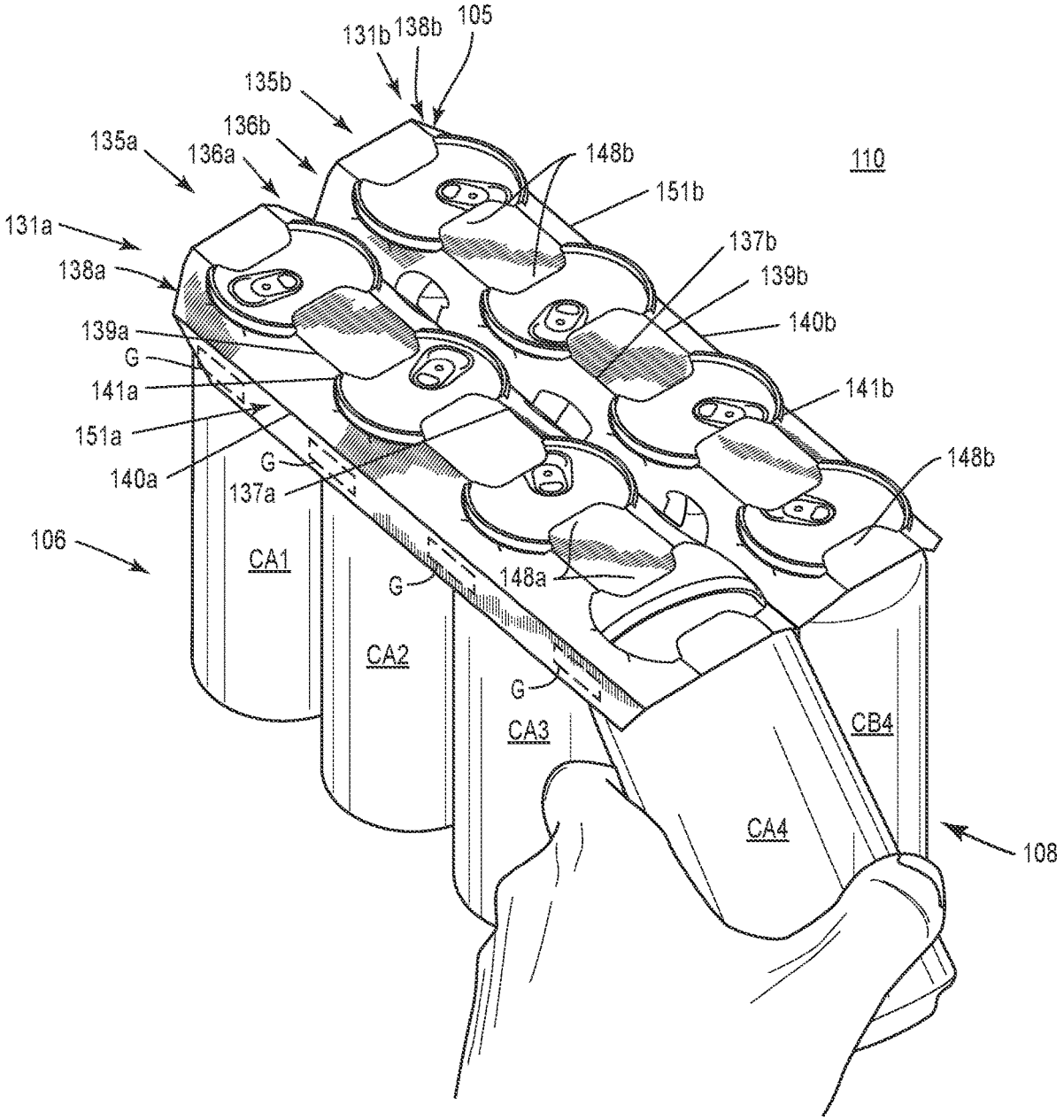
FIG. 7 is another perspective view of the package and carrier of FIG. 6 and showing a container being removed therefrom.

Upon formation of the package 110/carrier 105 as shown in FIG. 6, and with additional reference to FIG. 7, respective containers CA1, CA2, CA3, CA4, CB1, CB2, CB3, CB4 can be removed from the carrier 105 by disengaging the container from a respective attachment panel 131*a*, 131*b*, for example, by withdrawing the top portion T of a respective container through a respective container opening 141*a*, 141*b* along the respective attachment panel 131*a*, 131*b*, and peeling the respective container away from the respective central panel 125*a*, 125*b*, and further, away from the respective side panel 151*a*, 151*b*.

Peeling or pulling the containers CA1, CA2, CA3, CA4, CB1, CB2, CB3, CB4 away from a respective central panel 125*a*, 125*b* and a respective side panel 151*a*, 151*b* can involve pulling the respective container with a force sufficient to overcome the adhesive bond of the respective container and the respective central panel 125*a*, 125*b* and respective side panel 151*a*, 151*b* provided by the glue G. In one embodiment, the glue G can be selected so as to remain on a respective central panel 125*a*, 125*b* and/or a respective side panel 151*a*, 151*b*, e.g., such that substantially little or no glue G remains on the container as it is removed. In one embodiment, one or more of the containers CA1, CA2, CA3, CA4, CB1, CB2, CB3, CB4 can be reattached to a respective central panel 125*a*, 125*b* and/or a respective side panel 151*a*, 151*b* following therefrom by pressing the container against a respective region of glue G.

It will be understood that a different number of rows or arrangements of glue openings can be provided without departing from the disclosure, and that the central panels can be sized and configured to accommodate such arrangements. In one embodiment, the central panels 125*a*, 125*b* can be devoid of glue openings such that the respective containers CA1, CA2, CA3, CA4 and CB1, CB2, CB3, CB4 are adhered only to the respective central panel 125*a*, 125*b*. In another embodiment, glue G can be provided both on portions of the respective central panels 125*a*, 125*b* exposed through the respective glue openings 128, 127*b* and glue openings 127*a* as well as portions of the respective central panels 125*a*, 125*b* adjacent the respective glue openings such that each container CA1, CA2, CA3, CA4, CB1, CB2, CB3, CB4 can be adhered to portions of both central panels 125*a*, 125*b*.

Still referring to FIG. 6, the package 110/carrier 105 can be grasped by a consumer by inserting one or more of his or her fingers in one or more of the both handle openings 130*a*, 132*a*, 130*b*, 132*b* and engaging, for example, a portion of an underside of a respective attachment panel 131*a*, 131*b* and/or an edge of the respective handle openings 130*a*, 130*b*, 132*a*, 132*b*. The respective handle openings 130*a*, 132*a*, 130*b*, 132*b* can be configured so as to provide a consumer multiple edges and surfaces by which to engage and lift the carrier 105 such that the consumer can engage the carrier from multiple orientations, e.g., a lateral orientation or a longitudinal orientation, or orientations therebetween.

In addition, one or more portions of the respective handle reinforcement tabs 161*a*, 165*a*, 161*b*, 165*b* can fold downwardly at one or more of the respective fold lines 163*a*, 169*a*, 163*b*, 169*b* upon engagement with one or more of a user's fingers, for example, to provide a buffer or protective layer of material to protect a user's finger in the course of gripping the carrier 105 and/or to provide separation among adjacent containers.

The carrier 105/package 110 described above has a compact structure that can, for example, provide materials savings and waste reduction. Additionally, the arrangement of the glue G among the containers CA1, CA2, CA3, CA4, CB1, CB2, CB3, CB4 as well as the central panels 125*a*, 125*b* and the side panels 151*a*, 151*b* provides multiple points of attachment that results in a robust structure for holding and carrying the containers CA1, CA2, CA3, CB1, CB2, CB3, CB4. Further, the exposure of one or more portions of the containers CA1, CA2, CA3, CA4, CB1, CB2, CB3, CB4 on exterior portions of the package 110/carrier 105 as well as exposure of the top portions T of the respective containers through the container openings 141*a*, 141*b* provides a consumer with a clear view of labeling or surface graphics associated with the containers CA1, CA2, CA3, CA4, CB1, CB2, CB3, CB4 as well as providing convenient access to remove one or more of the containers CA1, CA2, CA3, CA4, CB1, CB2, CB3, CB4 from the carrier 105/package 110.

It will be understood that the carrier 105/package 110 can have a different configuration without departing from the disclosure. For example, in one embodiment, the container openings 141*a*, 141*b* can be replaced by a plurality of laterally-spaced cuts having the form of the curved edge portions 143*a*, 143*b* to provide additional coverage of the top portions of the containers.

Figure 8:
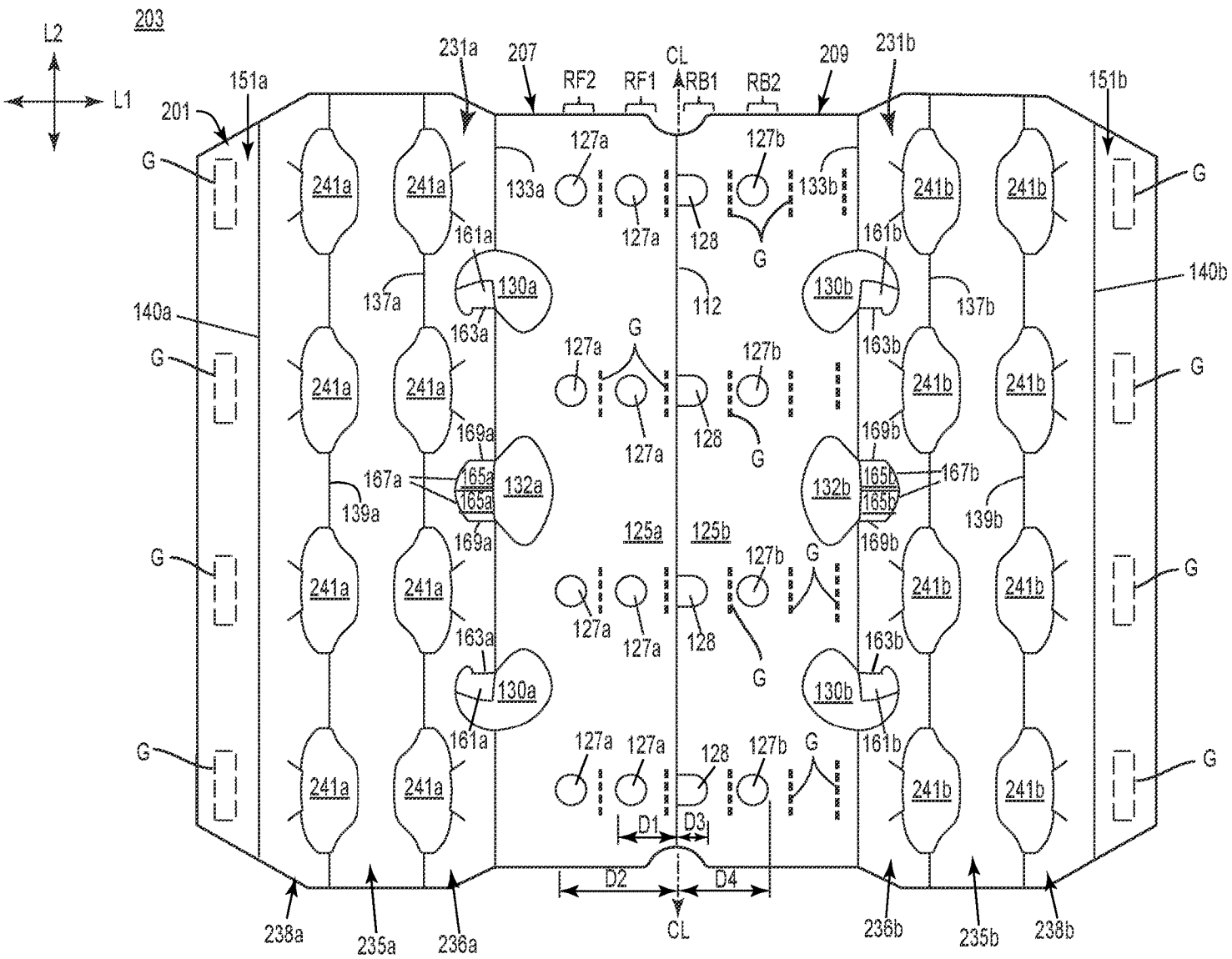
FIG. 8 is a schematic plan view of an outer surface of a blank for forming a carrier according to a second exemplary embodiment of the disclosure.
Figure 9:
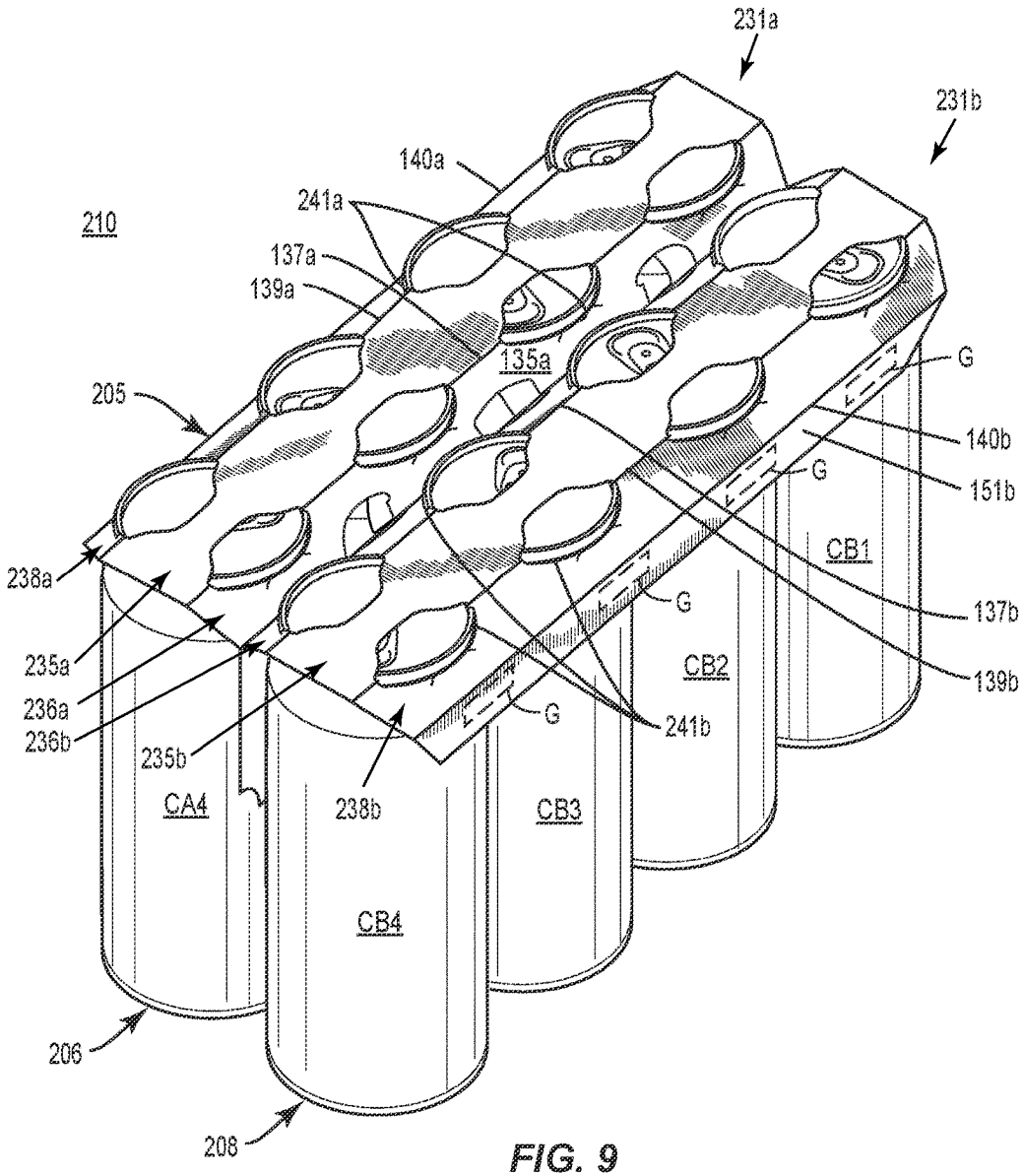
FIG. 9 is a perspective view of a package and carrier formed from the blank of FIG. 8 according to the second exemplary embodiment.

FIG. 8 is a plan view of the exterior side 201 of a blank, generally indicated at 203, used to form a carrier 205 (FIG. 9) for containing one or more containers according to a second exemplary embodiment of the disclosure. The blank 203 and the carrier 205 formed therefrom can have one or more substantially similar features to the blank 103 (FIG. 1) and the carrier 105 (FIG. 6) described above, and like or similar components are referenced with like or similar reference numbers. The carrier 205 formed from the blank 203 can be provided with one or more containers as a package 210 (FIG. 9).

As shown, the blank 203 includes a front portion 207 for forming a front portion 206 of the carrier 205 and a back portion 209 for forming a back portion 208 of the carrier 205. The front portion 207 of the blank includes a front attachment panel 231*a* having a container retention portion 235*a* defined between/proximate the fold lines 137*a*, 139*a*.

Figure 8B:
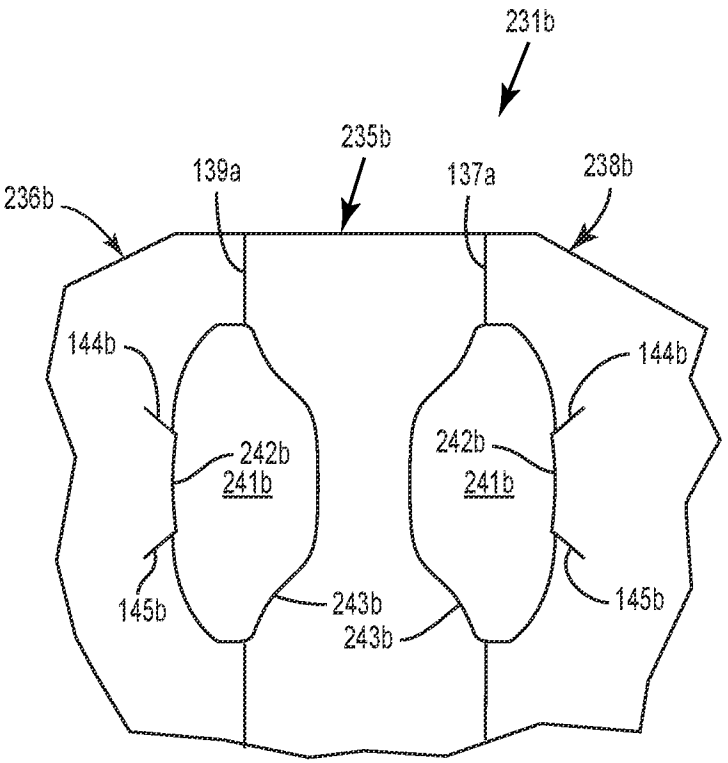
FIG. 8B is an enlarged view of another portion of the blank of FIG. 8.
Figure 8A:
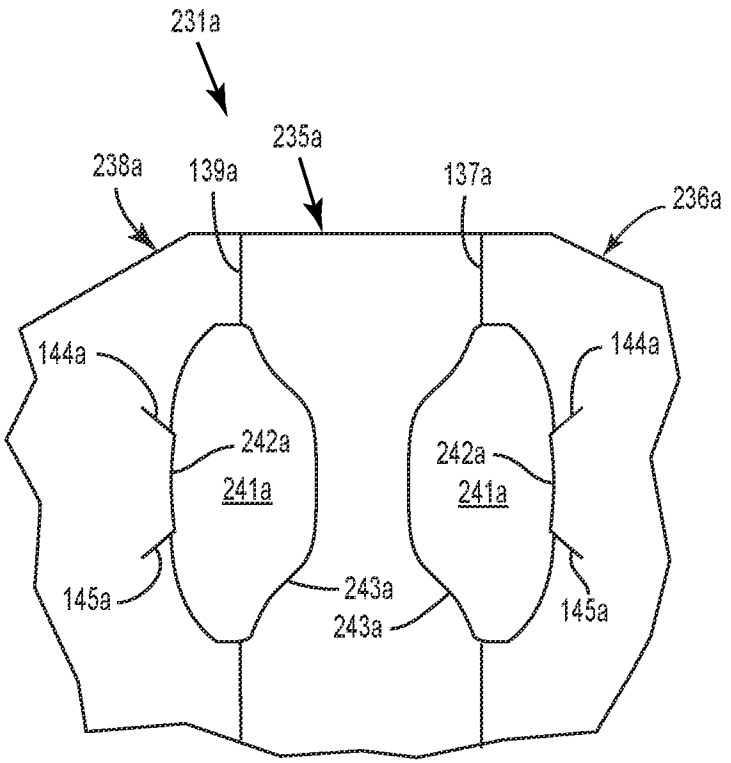
FIG. 8A is an enlarged view of a portion of the blank of FIG. 8.

As best shown in FIG. 8A, the container retention portion 235*a* of the front attachment panel 231*a* can include container retention features that include at least pairs of longitudinally spaced container openings 241*a* that interrupt the respective fold lines 137*a*, 139*a*. Each container opening 241*a*, as shown, is defined by a first or laterally outer curved edge portion 242*a* with endpoints that intersect the respective fold lines 137*a*, 139*a*, and a second or laterally inner curved edge portion 243*a* that extends from one endpoint to the other endpoint of the respective first curved edge portion 242*a*. In the illustrated embodiment, the container retention portion 235*a* can include a laterally-spaced plurality of the pairs longitudinally-spaced container openings 241*a*.

As also shown, respective oblique cuts 144*a*, 145*a* extend outwardly from each respective first curved edge portion 242*a* to define a plurality of reconfigurable edges of the front attachment panel 231*a* adjacent the respective container openings 241*a*.

In one embodiment, the second curved edge portions 242*a* can have an irregular, e.g., wave-like, curvature such that the container openings 241*a* have a generally tapered profile in the direction of the respective first curved edge portion 242*a* to the respective second curved edge portion 243*a*. It will be understood that the container retention features of the front attachment panel 231*a* can have a different configuration without departing from the disclosure.

In the illustrated embodiment, the back portion 209 of the blank 203 includes a back central panel 125*b*, a back container retention panel or back attachment panel 231*b*, and a back bevel panel or back side panel 151*b* having associated features that are generally a mirror-image of the corresponding panels and flaps of the front portion 207 of the blank 203. Corresponding components (e.g., panels, flaps, fold lines, cuts, etc.) have been designated by corresponding reference numbers that differ by the "a" or "b" suffix, with the "a" components corresponding to the front portion 207 of the blank 203 and the "b" components corresponding to the back portion 209 of the blank 203. The features of the container openings 241*b* of the back attachment panel 231*a* are best shown in FIG. 8B.

Referring additionally to FIG. 9, the carrier 205 and a package 210 that includes the carrier 205 and the containers CA1, CA2, CA3, CA4, CB1, CB2, CB3, CB4 can be formed in a similar manner as that described above with respect to the carrier 105/package 110.

With regard to the container retention features of the attachment panel 231*a*, the upper or top portions T of the respective containers CA1, CA2, CA3, CA4 can be at least partially received through the container openings 241*a* in the front attachment panel 231*a* such that a plurality of reconfigurable edges of the marginal portions 236*a*, 238*a* defined by the curved edge portions 242*a* of the container openings 241*a* and the oblique cuts 244*a*, 245*a* can engage, for example, a rolled rim edge or other top structure of the respective container CA1, CA2, CA3, CA4.

It will be understood that portions of the container retention portion 235*a* of the front attachment panel 231*a*, e.g., portions of the container retention portion 235*a* between adjacent container openings 241*a*, can flexibly reconfigure in the course of engaging respective containers.

Furthermore, the side panel 151*a* can adhesively engage the respective containers CA1, CA2, CA3, CA4 applied along its interior surface as described above with regard to the carrier 105/package 110.

The container retention features of the attachment panel 231*b* can engage the containers CB1, CB2, CB3, CB4 in a similar manner as described above with regard to the engagement of the attachment panel 231*a* with the containers CA1, CA2, CA3, CA4, and the side panel 151*b* can adhesively engage the containers CB1, CB2, CB3, CB4 in a manner similar to that described above with regard to the engagement of the side panel 151*a* with the containers CA1, CA2, CA3, CA4.

The carrier 205/package 210 provides the same or similar advantages to those described above with respect to the carrier 105/package 110, such as materials savings and waste reduction in a construct that provides multiple points of adhesive attachment of the material of the blank 203/carrier 205 to the respective containers, e.g., at the central panels 125*a*, 125*b* and side panels 151*a*, 151*b*, that results in a robust structure for holding and carrying containers. Such a configuration also exposes portions of the containers on exterior portions of the carrier 205/package 210, e.g., the upper portions T of the respective containers through the container openings 241*a*, 241*b* for enhanced product visibility.

It will be understood that the carrier 205/package 210 can have a different configuration without departing from the disclosure. For example, in one embodiment, the container openings 241*a*, 241*b* can be replaced by a plurality of laterally-spaced cuts having the form of the edge portions 143*a*, 143*b* to provide additional coverage of the top portions of the containers.

Figure 10:
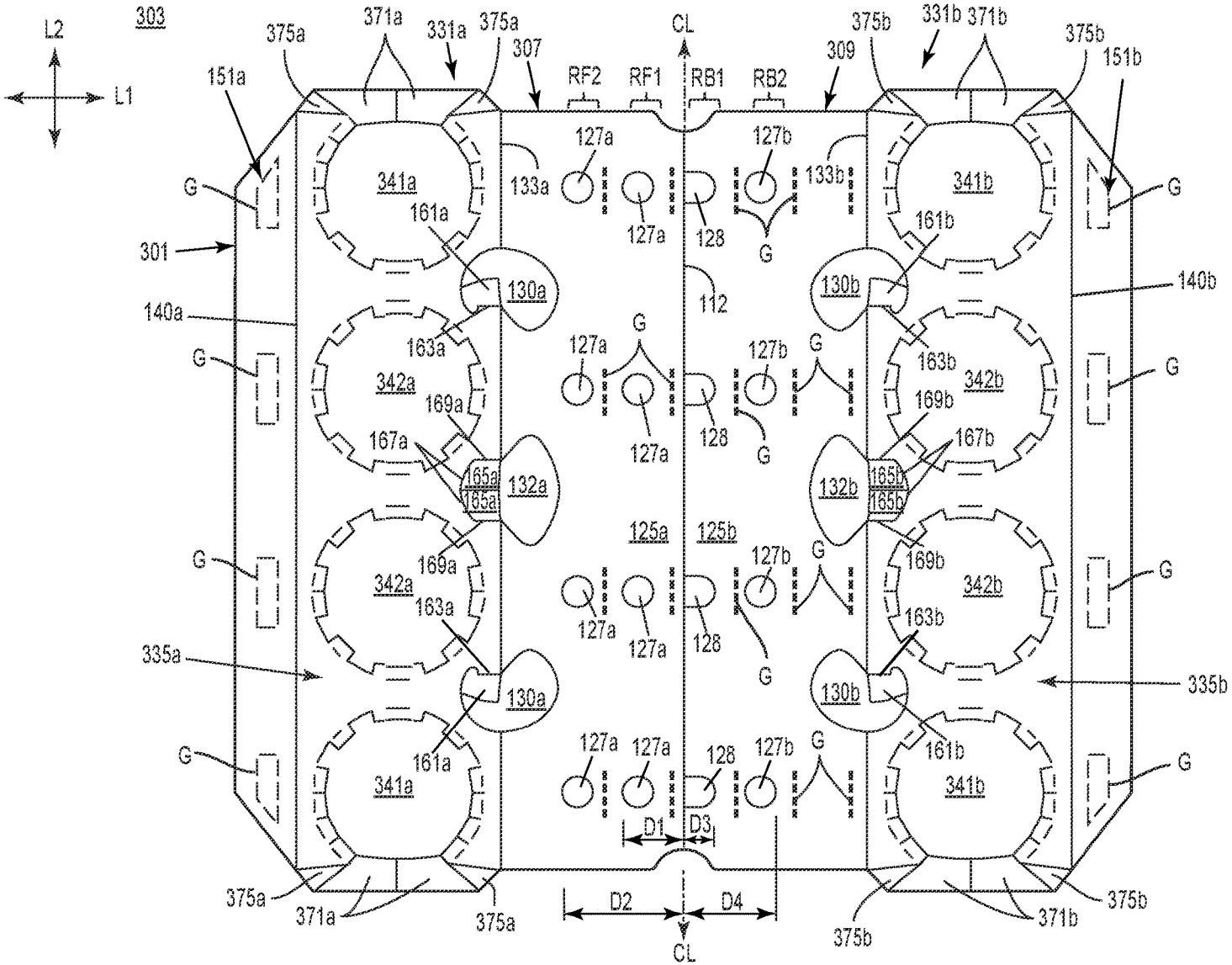
FIG. 10 is a schematic plan view of an outer surface of a blank for forming a carrier according to a third exemplary embodiment of the disclosure.
Figure 11:
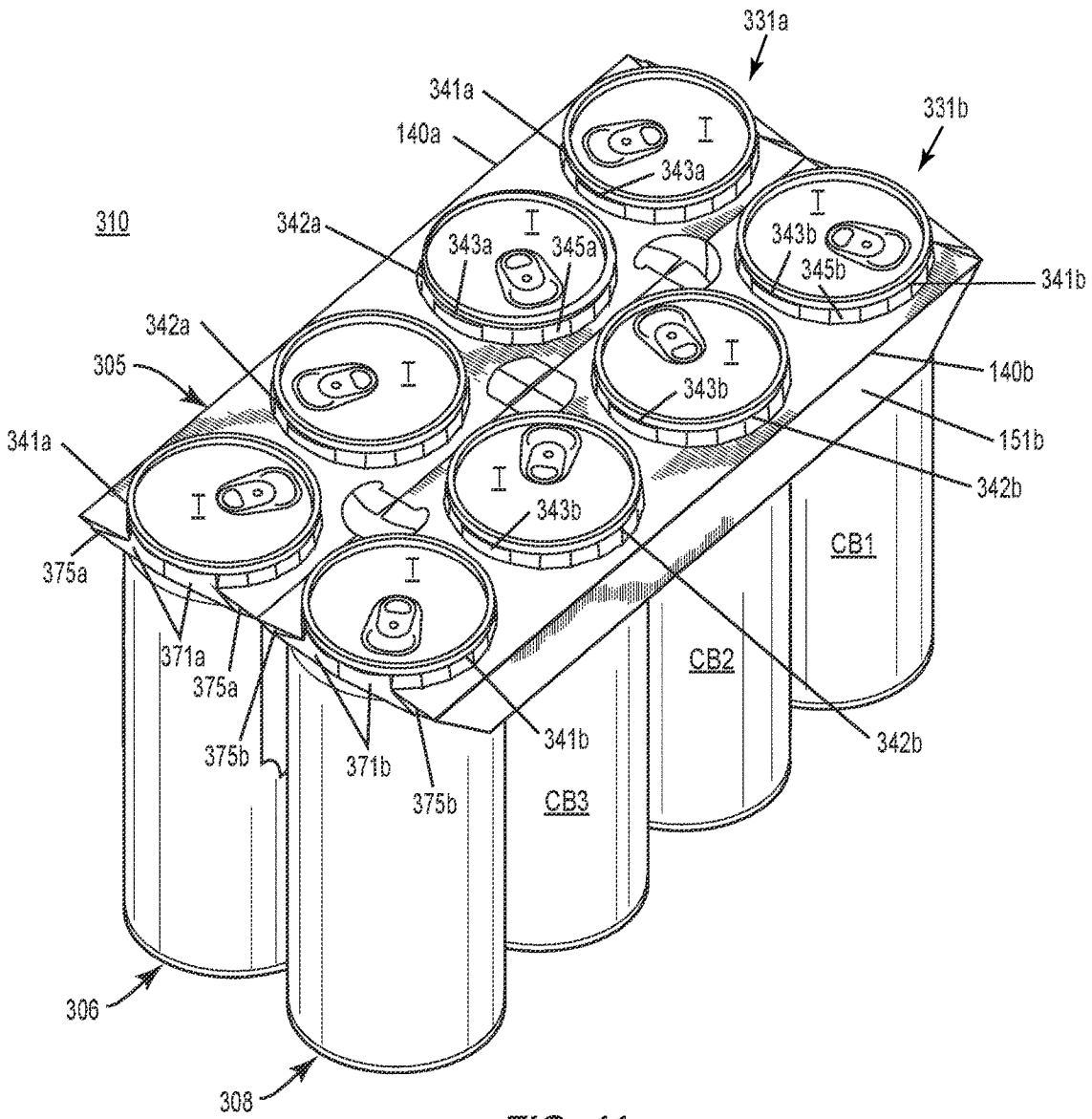
FIG. 11 is a perspective view of a package and carrier formed from the blank of FIG. 10 according to the third exemplary embodiment.

FIG. 10 is a plan view of the exterior side 301 of a blank, generally indicated at 303, used to form a carrier 305 (FIG. 11) for containing one or more containers according to a third exemplary embodiment of the disclosure. The blank 303 and the carrier 305 formed therefrom can have one or more substantially similar features to the blanks 103, 203 and the carriers 105, 205 described above, and like or similar components are referenced with like or similar reference numbers. The carrier 305 formed from the blank 303 can be provided with one or more containers as a package 310 (FIG. 11).

As shown, the blank 303 includes a front portion 307 for forming a front portion 306 of the carrier 305 and a back portion 309 for forming a back portion 308 of the carrier 305. The front portion 307 of the blank includes a front attachment panel 331*a* having a container retention portion 335*a*. As shown, the container retention portion 335*a* of the front attachment panel 331*a* is devoid of the fold lines 137*a*, 139*a*, but one of the fold lines 137*a*, 139*a* can be present without departing from the disclosure.

Figure 10B:
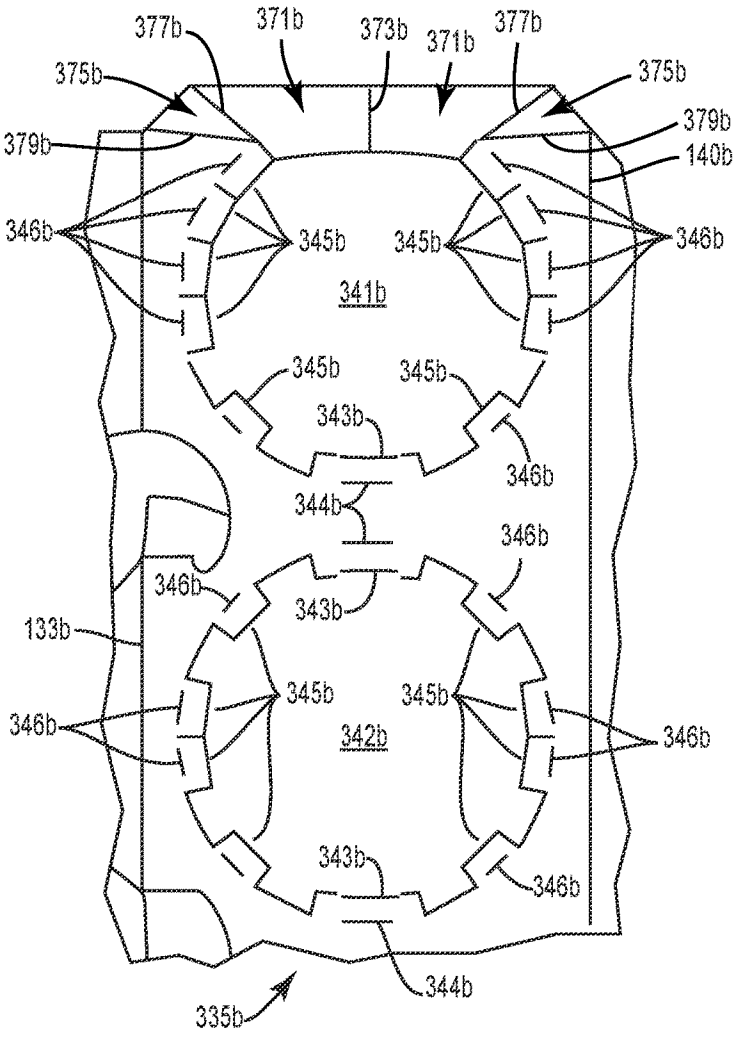
FIG. 10B is an enlarged view of another portion of the blank of FIG. 10.
Figure 10A:
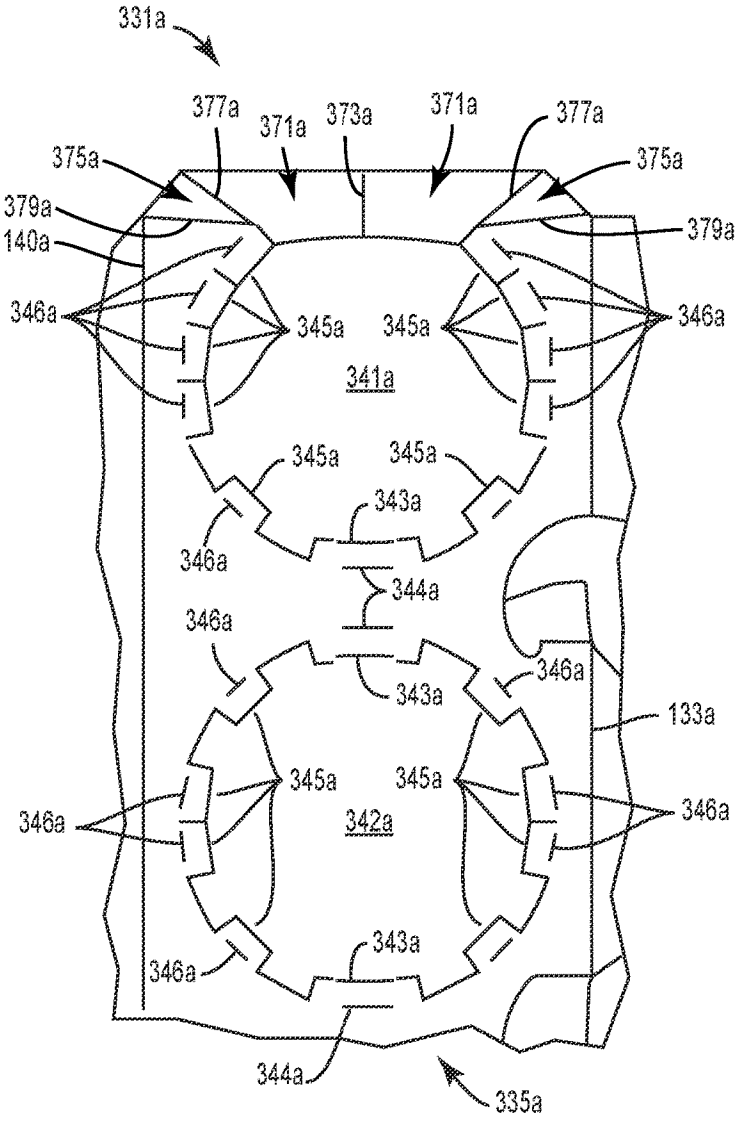
FIG. 10A is an enlarged view of a portion of the blank of FIG. 10.

With additional reference to FIG. 10A, the attachment panel 331*a* can include container retention features that include at least laterally outer container openings 341*a* proximate the lateral edges of the blank 303, and laterally inner container openings 342*a* positioned between the laterally outer container openings 341*a*. While the laterally outer container openings 341*a* are shown having a slightly different configuration than the laterally inner container openings 342*a*, it will be understood that the container openings 341*a*, 342*a* can have similar configurations without departing from the disclosure.

The laterally outer container openings 341*a*, as shown, have a generally circular profile, but can include one or more straight or chamfered edges. A plurality of container tabs is foldably connected to the attachment panel 331*a* and extends into the container opening 341*a*, and can include a major, e.g., relatively larger, container retention tab 343*a* at least partially foldably connected to the attachment panel 331*a* at a line of weakening or fold line 344*a*, and a plurality of minor, e.g., relatively smaller, container retention tabs

345*a* at least partially foldably connected to the attachment panel 331*a* at a line of weakening or fold line 346*a*.

As shown, circumferentially adjacent container retention tabs 343*a*, 345*a* can be positioned to abut each other, e.g., so as to be separated by a cut, or can be circumferentially spaced apart from one another along the edge of the container opening 341*a*.

As also shown in FIG. 10A, the laterally inner container openings 342*a* can have a configuration that is generally similar to the laterally outer container openings 341*a*. In the illustrated embodiment, the laterally inner container openings 342*a* can be devoid of a straight or chamfered edge, and can include a different number and/or arrangement of container retention tabs, e.g., a pair of laterally-opposed major container retention tabs 343*a* and a series of alternating circumferentially spaced and circumferentially abutting minor container retention tabs 345*a* therebetween along the edge of the container openings 342*a*. It will be understood that the container openings 341*a*, 342*a* can have similar or different configurations to one another, or can have a different configuration than illustrated, without departing from the disclosure.

Still referring to FIGS. 10 and 10A, the container retention features of the blank 303 and the carrier 305 formed therefrom can also include respective a plurality of container engagement flaps that is foldably connected to the lateral ends of the attachment panel 331*a*. As shown, each plurality of container engagement flaps includes a pair of major, e.g., relatively larger, container engagement flaps 371*a* foldably connected to one another at a lateral fold line 373*a*, and a pair of minor, e.g., relatively smaller, container engagement flaps 375*a* foldably connected to the respective container engagement flaps 371*a* at a respective oblique fold line 377*a* and to the attachment panel 331*a* at a respective oblique fold line 379*a*. As shown, the major container engagement flaps 371*a* can have laterally inner free edges that at least partially form an edge of the respective container openings 341*a*.

In the illustrated embodiment, the back portion 309 of the blank 303 includes a back central panel 125*b*, a back container retention panel or back attachment panel 331*b*, and a back bevel panel or back side panel 151*b* having associated features that are generally a mirror-image of the corresponding panels and flaps of the front portion 307 of the blank 303. Corresponding components (e.g., panels, flaps, fold lines, cuts, etc.) have been designated by corresponding reference numbers that differ by the "a" or "b" suffix, with the "a" components corresponding to the front portion 307 of the blank 303 and the "b" components corresponding to the back portion 309 of the blank 303. The features of the back attachment panel 331*a* are best shown in FIG. 10B.

Referring additionally to FIG. 11, the carrier 305 and a package 310 that includes the carrier 305 and the containers CA1, CA2, CA3, CA4, CB1, CB2, CB3, CB4 can be formed in a similar manner as that described above with respect to the carrier 105/package 110 and carrier 205/package 210.

With regard to the container retention features of the carrier 305, the upper or top portions T of the respective containers CA1, CA2, CA3, CA4 can be at least partially received through the respective container openings 341*a*, 342*a* in the front attachment panel 331*a*. During such movement, the container retention tabs 343*a*, 345*a* can contact the top portions T of respective containers such that the container retention tabs 343*a*, 345*a* are urged to fold at least partially upwardly at the respective fold lines 344*a*, 346*a* so as to be positioned to engage, for example, a rolled rim edge or other top structure of the respective container CA1, CA2, CA3, CA4.

In addition, the container engagement flaps 375*a* can fold downwardly relative to the attachment panel 331*a* at the respective fold lines 379*a* to position the container engagement flaps 371*a* to fold relative to each other at the fold line 373*a* and to fold relative to the container engagement flaps 375*a* at the respective fold lines 377*a*. In the illustrated arrangement, the container engagement flaps 371*a* are obliquely arranged relative to one another and obliquely downwardly arranged relative to the attachment panel 331*a* such that the laterally inner free edges of the container engagement flaps 371*a* are positioned to contact or engage a rolled rim or other top structure of the respective containers CA1, CA4.

Furthermore, the side panel 151*a* can adhesively engage the respective containers CA1, CA2, CA3, CA4 applied along its interior surface as described above with regard to the carrier 105/package 110 and the carrier 205/package 210.

The container retention features of the attachment panel 331*b* can engage the containers CB1, CB2, CB3, CB4 in a similar manner as described above with regard to the engagement of the attachment panel 331*a* with the containers CA1, CA2, CA3, CA4, and the side panel 151*b* can adhesively engage the containers CB1, CB2, CB3, CB4 in a manner similar to that described above with regard to the engagement of the side panel 151*a* with the containers CA1, CA2, CA3, CA4.

The carrier 305/package 310 provides the same or similar advantages to those described above with respect to the carrier 105/package 110 and carrier 205/package 210, such as materials savings and waste reduction, in a construct that provides multiple points of adhesive attachment of the material of the blank 303/carrier 305 to the respective containers, e.g., at the central panels 125*a*, 125*b* and side panels 151*a*, 151*b*, that results in a robust structure for holding and carrying containers. Such a configuration also exposes portions of the containers on exterior portions of the carrier 305/package 310, e.g., the upper portions T of the respective containers through the container openings 341*a*, 341*b*, 342*a*, 342*b* for enhanced product visibility.

It will be understood that the blanks, carriers, and packages described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising at least one central panel, at least one attachment panel foldably connected to the at least one central panel and configured to receive a portion of at least one container of the plurality of containers, and at least one side panel foldably connected to the at least one attachment panel, the at least one central panel comprises a plurality of openings and is positioned between and attached to adjacent containers of the plurality of containers, and the at least one side panel is attached to at least one container of the plurality of containers, the plurality of openings comprises a first row of openings and a second row of openings spaced apart from the first row of openings.

2. The carrier of claim 1, wherein the at least one side panel is adhered to adjacent containers of the plurality of containers.

3. The carrier of claim 2, wherein the at least one side panel is adhered to adjacent containers of the plurality of containers with glue.

4. The carrier of claim 3, wherein the at least one central panel is adhered to adjacent containers of the plurality of containers with glue.

5. The carrier of claim 2, wherein the at least one central panel is a front central panel, the at least one attachment panel is a front attachment panel attached to adjacent containers of the plurality of containers, the at least one side panel is a front side panel, and the carrier further comprises a back central panel foldably connected to the front central panel, a back attachment panel foldably connected to the back central panel, and a back side panel foldably connected to the back attachment panel, the back attachment panel is attached to adjacent containers of the plurality of containers.

6. The carrier of claim 1, wherein the first row of openings is spaced a first distance from a bottom edge of the at least one central panel, and the second row of openings is spaced a second distance from the bottom edge of the at least one central panel, the second distance is greater than the first distance.

7. The carrier of claim 6, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

8. The carrier of claim 7, wherein the first plurality of openings is offset from the second plurality of openings.

9. The carrier of claim 8, wherein the front central panel and the back central panel are in at least partial face-to-face contact such that a respective portion of the back central panel is exposed through the first plurality of openings and a respective portion of the front central panel is exposed through the second plurality of openings, the respective portion of the front central panel and the respective portion of the back central panel are for receiving an adhesive.

10. The carrier of claim 1, wherein the at least one attachment panel comprises at least one container opening for at least partially receiving a container of the plurality of containers.

11. The carrier of claim 10, wherein the at least one container opening defines at least one container retention tab extending into the at least one container opening.

12. The carrier of claim 10, wherein the at least one container opening comprises a pair of longitudinally-spaced container openings.

13. The carrier of claim 10, wherein the at least one container opening comprises a plurality of pairs of longitudinally-spaced container openings.

14. The carrier of claim 10, wherein a plurality of container retention tabs is foldably connected to the at least one attachment panel and extend into the at least one container opening.

15. The carrier of claim 14, wherein at least one container retention tab of the plurality of container retention tabs is positioned circumferentially abutting an adjacent container retention tab of the plurality of container retention tabs.

16. The carrier of claim 14, wherein at least one container retention tab of the plurality of container retention tabs is positioned circumferentially spaced apart from an adjacent container retention tab of the plurality of container retention tabs.

17. A blank for forming a carrier for holding a plurality of containers, the blank comprising:

a plurality of panels comprising at least one central panel, at least one attachment panel foldably connected to the at least one central panel and configured to receive a portion of at least one container of the plurality of containers, and at least one side panel foldably connected to the at least one attachment panel, the at least one central panel comprises a plurality of openings and is for being positioned between and attached to adjacent containers of the plurality of containers when the container is formed from the blank, and the at least one side panel is for being attached to at least one container of the plurality of containers when the container is formed from the blank, the plurality of openings comprises a first row of openings and a second row of openings spaced apart from the first row of openings.

18. The blank of claim 17, wherein the at least one side panel is for being adhered to adjacent containers of the plurality of containers.

19. The blank of claim 18, wherein the at least one side panel is for being adhered to adjacent containers of the plurality of containers with glue.

20. The blank of claim 19, wherein the at least one central panel is for being adhered to adjacent containers of the plurality of containers with glue.

21. The blank of claim 18, wherein the at least one central panel is a front central panel, the at least one attachment panel is a front attachment panel attached to adjacent containers of the plurality of containers, the at least one side panel is a front side panel, and the carrier further comprises a back central panel foldably connected to the front central panel, a back attachment panel foldably connected to the back central panel, and a back side panel foldably connected to the back attachment panel, the back attachment panel is for being attached to adjacent containers of the plurality of containers.

22. The blank of claim 17, wherein the first row of openings is for being spaced a first distance from a bottom edge of the at least one central panel when the carrier is formed from the blank, and the second row of openings is for being spaced a second distance from the bottom edge of the at least one central panel when the carrier is formed from the blank, the second distance is greater than the first distance.

23. The blank of claim 22, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel when the carrier is formed from the blank.

24. The blank of claim 23, wherein the first plurality of openings is for being offset from the second plurality of openings when the carrier is formed from the blank.

25. The blank of claim 24, wherein the front central panel and the back central panel are for being in at least partial face-to-face contact when the carrier is formed from the blank such that a respective portion of the back central panel is exposed through the first plurality of openings and a respective portion of the front central panel is exposed through the second plurality of openings, the respective portion of the front central panel and the respective portion of the back central panel are for receiving an adhesive.

26. The blank of claim 17, wherein the at least one attachment panel comprises at least one container opening for at least partially receiving a container of the plurality of containers.

27. The blank of claim 26, wherein the at least one container opening defines at least one container retention tab extending into the at least one container opening.

28. The blank of claim 26, wherein the at least one container opening comprises a pair of longitudinally-spaced container openings.

29. The blank of claim 26, wherein the at least one container opening comprises a plurality of pairs of longitudinally-spaced container openings.

30. The blank of claim 26, wherein a plurality of container retention tabs is foldably connected to the at least one attachment panel and extend into the at least one container opening.

31. The blank of claim 30, wherein at least one container retention tab of the plurality of container retention tabs is positioned circumferentially abutting an adjacent container retention tab of the plurality of container retention tabs.

32. The blank of claim 30, wherein at least one container retention tab of the plurality of container retention tabs is positioned circumferentially spaced apart from an adjacent container retention tab of the plurality of container retention tabs.

33. A method of forming a carrier for holding a plurality of containers, the method comprising:

obtaining a blank comprising a plurality of panels comprising at least one central panel comprising a plurality of openings, at least one attachment panel foldably connected to the at least one central panel and configured to receive a portion of at least one container of the plurality of containers, and at least one side panel foldably connected to the at least one attachment panel, the plurality of openings comprises a first row of openings and a second row of openings spaced apart from the first row of openings;

folding the plurality of panels such that the at least one central panel is positioned between adjacent containers of the plurality of containers;

attaching the at least one central panel to the adjacent containers of the plurality of containers;

attaching the at least one attachment panel to at least one container of the plurality of containers; and attaching the at least one side panel to at least one container of the plurality of containers.

34. The method of claim 33, wherein the at least one side panel is adhered to adjacent containers of the plurality of containers.

35. The method of claim 34, wherein the at least one side panel is adhered to adjacent containers of the plurality of containers with glue.

36. The method of claim 34, wherein the at least one central panel is a front central panel, the at least one attachment panel is a front attachment panel attached to adjacent containers of the plurality of containers, the at least one side panel is a front side panel, and the blank further comprises a back central panel foldably connected to the front central panel, a back attachment panel foldably connected to the back central panel, and a back side panel foldably connected to the back attachment panel, the method further comprises attaching the back attachment panel to adjacent containers of the plurality of containers.

37. The method of claim 36, wherein the at least one central panel is adhered to adjacent containers of the plurality of containers with glue.

38. The method of claim 33, wherein the folding the plurality of panels comprises positioning the first row of openings spaced a first distance from a bottom edge of the at least one central panel, and the folding the plurality of panels comprises positioning the second row of openings spaced a second distance from the bottom edge of the at least one central panel, the second distance is greater than the first distance.

39. The method of claim 38, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings, the folding the plurality of panels comprises positioning the first plurality of openings in communication with the back central panel and positioning the second plurality of openings in communication with the front central panel.

40. The method of claim 39, wherein the first plurality of openings is offset from the second plurality of openings.

41. The method of claim 40, wherein the folding the plurality of panels comprises positioning the front central panel and the back central panel in at least partial face-to-face contact such that a respective portion of the back central panel is exposed through the first plurality of openings and a respective portion of the front central panel is exposed through the second plurality of openings, the respective portion of the front central panel and the respective portion of the back central panel are for receiving an adhesive.

42. The method of claim 33, wherein the at least one attachment panel comprises at least one container opening for at least partially receiving a container of the plurality of containers.

43. The method of claim 42, wherein the at least one container opening defines at least one container retention tab extending into the at least one container opening.

44. The method of claim 42, wherein the at least one container opening comprises a pair of longitudinally-spaced container openings.

45. The method of claim 42, wherein the at least one container opening comprises a plurality of pairs of longitudinally-spaced container openings.

46. The method of claim 42, wherein a plurality of container retention tabs is foldably connected to the at least one attachment panel and extends into the at least one container opening.

47. The method of claim 46, wherein at least one container retention tab of the plurality of container retention tabs is positioned circumferentially abutting an adjacent container retention tab of the plurality of container retention tabs.

48. The method of claim 46, wherein at least one container retention tab of the plurality of container retention tabs is positioned circumferentially spaced apart from an adjacent container retention tab of the plurality of container retention tabs.

49. A package, comprising:

a plurality of containers; and a carrier holding the plurality of containers, the carrier comprising:

a plurality of panels comprising at least one central panel, at least one attachment panel foldably connected to the at least one central panel and receiving a portion of at least one container of the plurality of containers, and at least one side panel foldably connected to the at least one attachment panel, the at least one central panel comprises a plurality of openings and is positioned between and attached to adjacent containers of the plurality of containers, and the at least one side panel is attached to at least one container of the plurality of containers, the plurality of openings comprises a first row of openings and a second row of openings spaced apart from the first row of openings.

50. The package of claim 49, wherein the at least one side panel is adhered to adjacent containers of the plurality of containers.

51. The package of claim 50, wherein the at least one side panel is adhered to adjacent containers of the plurality of containers with glue.

52. The package of claim 51, wherein the at least one central panel is adhered to adjacent containers of the plurality of containers with glue.

53. The package of claim 50, wherein the at least one central panel is a front central panel, the at least one attachment panel is a front attachment panel attached to adjacent containers of the plurality of containers, the at least one side panel is a front side panel, and the carrier further comprises a back central panel foldably connected to the front central panel, a back attachment panel foldably connected to the back central panel, and a back side panel foldably connected to the back attachment panel, the back attachment panel is attached to adjacent containers of the plurality of containers.

54. The package of claim 49, wherein the first row of openings is spaced a first distance from a bottom edge of the at least one central panel, and the second row of openings is spaced a second distance from the bottom edge of the at least one central panel, the second distance is greater than the first distance.

55. The package of claim 54, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

56. The package of claim 55, wherein the first plurality of openings is offset from the second plurality of openings.

57. The package of claim 56, wherein the front central panel and the back central panel are in at least partial face-to-face contact such that a respective portion of the back central panel is exposed through the first plurality of openings and a respective portion of the front central panel is exposed through the second plurality of openings, the respective portion of the front central panel and the respective portion of the back central panel are for receiving an adhesive.

58. The package of claim 49, wherein the at least one attachment panel comprises at least one container opening at least partially receiving a container of the plurality of containers.

59. The package of claim 58, wherein the at least one container opening defines at least one container retention tab extending into the at least one container opening.

60. The package of claim 58, wherein the at least one container opening comprises a pair of longitudinally-spaced container openings.

61. The package of claim 58, wherein the at least one container opening comprises a plurality of pairs of longitudinally-spaced container openings.

62. The package of claim 58, wherein a plurality of container retention tabs is foldably connected to the at least one attachment panel and extend into the at least one container opening.

63. The package of claim 62, wherein at least one container retention tab of the plurality of container retention tabs is positioned circumferentially abutting an adjacent container retention tab of the plurality of container retention tabs.

64. The package of claim 62, wherein at least one container retention tab of the plurality of container retention tabs is positioned circumferentially spaced apart from an adjacent container retention tab of the plurality of container retention tabs.

* * * * *